US011476577B2

(12) United States Patent
Merola et al.

(10) Patent No.: US 11,476,577 B2
(45) Date of Patent: Oct. 18, 2022

(54) ULTRAWIDEBAND PARALLEL PLATE LENS MULTI-BEAMFORMER APPARATUS AND METHOD

(71) Applicant: University of Massachusetts, Boston, MA (US)

(72) Inventors: Christopher S. Merola, Northampton, MA (US); Marinos N. Vouvakis, Leverett, MA (US)

(73) Assignee: UNIVERSITY OF MASSACHUSETTS, Boston, MA (US)

( * ) Notice: Subject to any disclaimer, the term of this patent is extended or adjusted under 35 U.S.C. 154(b) by 55 days.

(21) Appl. No.: 16/902,595

(22) Filed: Jun. 16, 2020

(65) Prior Publication Data

US 2020/0403310 A1 Dec. 24, 2020

Related U.S. Application Data

(60) Provisional application No. 62/872,206, filed on Jul. 9, 2019, provisional application No. 62/872,212, filed on Jul. 9, 2019, provisional application No. 62/862,970, filed on Jun. 18, 2019.

(51) Int. Cl.
*H01Q 3/46* (2006.01)

(52) U.S. Cl.
CPC ..... *H01Q 3/46* (2013.01)

(58) Field of Classification Search
CPC ..... H01Q 3/46; H01Q 9/36
See application file for complete search history.

(56) References Cited

U.S. PATENT DOCUMENTS 5,835,067 A * 11/1998 Goodman ..... H01Q 9/36 343/722
2012/0256796 A1* 10/2012 Leiba ..... H01Q 9/38 343/781 R
2019/0103665 A1* 4/2019 Yoo ..... H01Q 21/062

FOREIGN PATENT DOCUMENTS

RU 177950 * 7/2017
WO WO2008075093 * 11/2007

OTHER PUBLICATIONS

Andreas Lambrecht et al., True-Time-Delay Beamforming With a Rotman-Lens for Ultrawideband Antenna Systems, IEEE Transactions on Antennas and Propagation, vol. 58, No. 10, Oct. 2010, pp. 3189-3195.

John T. Logan et al., A New Class of Planar Ultrawideband Modular Antenna Arrays With Improved Bandwidth, IEEE Transactions on Antennas and Propagation, vol. 66, No. 2, Feb. 2018, pp. 692-701.

* cited by examiner

*Primary Examiner* — Awat M Salih
(74) *Attorney, Agent, or Firm* — Renner, Otto, Boisselle & Sklar, LLP

(57) ABSTRACT

A parallel plate lens including a top plate, a bottom plate, a side-wall coupled to the top plate and the bottom plate to form the parallel plate lens with a cavity, and a plurality of capacitive probe feeds disposed in the cavity at a spacing interval associated with a guided wavelength (λ) within the cavity.

19 Claims, 15 Drawing Sheets

ULTRAWIDEBAND PARALLEL PLATE LENS MULTI-BEAMFORMER APPARATUS AND METHOD

CROSS REFERENCE TO RELATED APPLICATIONS

This application claims priority to and the benefit under 35 U.S.C. § 119(e) of U.S. provisional Application No. 62/862,970 titled "CAVITY-BASED MULTI-BEAMFORMER WITH WIDE BANDWIDTH" and filed on Jun. 18, 2019; U.S. provisional Application No. 62/872,212 titled "RF BEAMFORMING ARCHITECTURE FOR ULTRA-WIDEBAND CONTINUOUS TIME-DELAY CONTROL" and filed on Jul. 9, 2019; and U.S. provisional Application No. 62/872,206 titled "COMPACT ULTRAWIDEBAND CONSTRAINED LENS MULTI-BEAMFORMER" and filed on Jul. 9, 2019, which are herein incorporated by reference in their entirety for all purposes.

BACKGROUND

The roll out of 5G wireless networks will require back-haul or even edge terminals that leverage massive MIMO and broadband operation at sub-6GHz to achieve the desired data throughput rates. Low-cost, high gain multibeam antenna arrays are a necessary component for achieving this high level of spatial multiplexing. The networks for feeding such arrays may operate in either the RF, IF, optical, or digital domain. Passive, low-cost, bandwidth RF multi-beamformers include dielectric unconstrained lenses or microstrip, stripline, or waveguide constrained lenses. Conventional constrained lenses suffer from resonances when a system is wideband and are only able to achieve high efficiency over narrow bandwidths. For example, radiation losses of a microstrip lens and resonant behavior of stripline and waveguide lenses have poor wide-angle scan performance due to horn feed ports.

While most research in the area of 5G and mmWaves have focused on active RF beamformers based on CMOS or SiGe chips, it is hard to envision how those approaches could scale up to practical massive MIMO systems with hundreds of simultaneous beams and thousands of array elements, in terms of cost, complexity and power consumption.

One approach includes Electronic Scanned Arrays (ESAs) that rely on beamforming hardware to perform a delay-and-sum (or a phase shift-and-sum) operation needed for beam-steering. This operation can be performed directly on the RF signal path, or alternatively in auxiliary domains such as intermediate frequency, local oscillator, digital, or even acoustic or photonic. In terms of space, weight, and power and cost (SWaP-C), each approach offers advantages and shortcomings that depend on application-specific metrics such as dynamic range, bandwidth, frequency range, and the like. RF beamforming is favored for ESA deployments in interference-rich or jammer-rich environments such as cellular, SATCOM, RADAR or EW systems, because of its ability to reject undesired out-of-the-beam and out-of-band (e.g., IIP3) signals before reaching mixers or ADCs.

In RF beamforming, maintaining low signal distortion and low insertion loss (or power consumption) with good power handling is critical. The importance of maintaining low signal distortion and low insertion loss is intensified at high instantaneous bandwidths, e.g., UWB RADARs or multi-functional RF systems, because UWB power dividers/combiners are large and lossy (or power hungry), and, more importantly, because true-time delay (TTD) units must be used in place of phase shifters to avoid beam squinting and array inter-symbol interference (ISI). Most TTD units are digital (n bits), resulting in 2n scan directions and higher side-lobes (quantization lobes).

For conventional 1D timed arrays, discrete beamforming is possible via Rotman lens or Blass matrix switched-beam beamformers. While Rotman lens or Blass matrix switched-beam beamformers are passive and equivalent to multiple discrete TTD units and power combiners, these beamformers generally offer few possible scan angles.

Another conventional approach includes continuous timed-array beamformers to increase the number of scan angles, but this approach relies on tunable delay-lines that are either printed on ferroelectric or liquid crystal materials, or are loaded with varactors or inverting amplifiers (Miller effect), and thus are even more lossy or power hungry than Rotman lens or Blass matrix switched-beam beamformers.

Accordingly, there is a need in the art for a beamformer with low signal distortion and low insertion loss and good power handling. Furthermore, there is a need for a low-cost, volume manufacturable fully passive multi-beamforming (true-time delay) network with high efficiency and squint-free patterns over wide bandwidths.

SUMMARY

The present invention provides a new wideband parallel plate lens multi-beamformer apparatus and method. The wideband parallel plate lens multi-beamformer includes ports coupled to vertical probes over a ground plane backing in an electrically sealed cavity shaped according to Rotman lens equations. As described herein, a relatively simple strategy for providing an improved cavity-based ultra-wide-band (UWB) multi-beamformer has been developed. The potential applications of the wideband parallel plate lens multi-beamformer described herein include enhanced data throughput rates for massive MIMO and broadband operation at sub-6 GHz frequencies. The wideband parallel plate lens multi-beamformer described herein also overcomes the size, bandwidth, efficiency, and EMC/EMI limitations of conventional microstrip, stripline or waveguide Rotman lenses.

The present disclosure also includes a low-cost, volume manufacturable fully passive true time delay (TTD) ultra-wideband (UWB) multi-beamforming compact parallel plate lens with high efficiency and squint-free patterns. The potential applications of the compact parallel plate lens include enhanced data throughput rates for massive MIMO and broadband operation at microwave and millimeter frequencies. The compact parallel plate lens introduces a new class of RF multi-beamformer that overcomes the size, efficiency, and EMC/RFI limitations of conventional microstrip Rotman lenses.

Additionally, the present disclosure provides an RF beamforming architecture that provides UWB continuous TTD for timed array beam-steering. The architecture uses the TTD UWB multi-beamforming parallel plate lens described herein and an electronic network consisting of power dividers, switches and variable attenuators (or amplifiers) that are responsible for moving the beam port phase center around the lens beam arc. This continuous movement is translated into TTD control at the array ports by the optics of the lens resulting in an increased number of scan angles at high instantaneous bandwidths. The increased number of scan angles provides a system configured to steer a beam to accommodate for small shifts in antenna position that impact transmit/receive efficiency such as vibrations caused by wind, vehicle movement, etc.

The potential applications of the present invention include enhanced data throughput rates for massive MIMO and broadband operation; mobile device beam steering; satellite communications beam steering such as low-earth orbit and medium-earth orbit communications; rural broadband internet; and the like. The present disclosure introduces a new class of RF multi-beamformer that overcomes the size, efficiency, and EMC/EMI limitations of conventional techniques.

According to one aspect, there is provided a parallel plate wave conducting lens including a top plate, a bottom plate, a side-wall coupled to the top plate and the bottom plate to form the parallel plate wave conducting lens with a sealed cavity, and a plurality of capacitive probe feeds disposed in the sealed cavity at a spacing interval associated with a guided wavelength (λ) within the cavity. According to a further embodiment, one or more capacitive probe feeds of the plurality of capacitive probe feeds are coupled to an array port and one or more capacitive probe feeds of the plurality of capacitive probe feeds are coupled to a beam port to cause a true time delay shift of energy input into the parallel plate wave conducting lens.

According to a further embodiment of the parallel plate wave conducting lens, the spacing interval corresponds to approximately one-half the guided wavelength (λ/2) at the highest frequency of operation.

According to another embodiment, the parallel plate wave conducting lens further includes a plurality of transmission lines connecting each capacitive probe feed of the plurality of capacitive probe feeds to a respective beam port and each capacitive probe feed to a respective array port, wherein each transmission line is characterized by a line length associated with a specific impedance.

According to another embodiment, two capacitive probe feeds of the plurality capacitive probe feeds are coupled to form a resistive divider.

According to another embodiment, each capacitive probe feed of the plurality of capacitive probe feeds are positioned at a distance from the side-wall corresponding to one-half the guided wavelength at the highest frequency of operation.

According to another embodiment, the plurality of capacitive probes is disposed at the spacing interval to define a concentric array with the side-wall of the sealed cavity.

According to another embodiment, the parallel plate wave conducting lens includes a dielectric material positioned in the sealed cavity wherein the plurality of capacitive probe feeds are disposed in the dielectric material.

According to another embodiment, the parallel plate wave conducting lens includes a backing cavity formed between the plurality of capacitive probe feeds and the cavity wall. According to yet another embodiment, the backing cavity comprises at least one or more of air and a dielectric material.

According to another embodiment, the parallel plate wave conducting lens includes a metal cap coupled to each capacitive probe feed of the plurality of capacitive probe feeds.

According to another embodiment, one or more capacitive probe feeds of the plurality of capacitive probe feeds is coupled to a termination.

According to another embodiment, the parallel plate wave conducting lens includes a plurality of transmission lines connecting each capacitive probe feed of the plurality of capacitive probe feeds to a corresponding lead disposed on the bottom plate.

According to another aspect, there is provided a passive beamformer including a parallel plate wave conducting lens formed in a multilayer package including a top plate, a bottom plate, a plurality of cavity wall vias coupled to the top plate and the bottom plate to form a cavity, a plurality of capacitive probe feeds, and a step-down ring disposed below the top plate and above the plurality of capacitive prove feeds, wherein the step-down ring is coupled to the top plate. According to a further embodiment, one or more of the plurality of capacitive probe feeds are coupled to an array terminal and one or more of the plurality of capacitive probe feeds are coupled to a beam terminal.

According to another embodiment, each probe of the plurality of capacitive probe feeds has a probe-to-cavity wall via spacing proportional to the guided wavelength.

According to another embodiment, the probe-to-via spacing is one-half of the guided wavelength at the highest operating frequency.

According to yet another embodiment a passive beamformer includes a parallel plate wave conducting lens formed in a multilayer package comprising a top plate, a bottom plate, a plurality of cavity wall vias coupled to the top plate and the bottom plate having a cavity wall spacing proportional to a guided wavelength at a highest operating frequency to form a cavity, a plurality of capacitive probe feeds having a probe-to-probe spacing proportional to the guided wavelength at the highest operating frequency, wherein one or more of the plurality of capacitive probe feeds are coupled to an array terminal and one or more of the plurality of capacitive probe feeds are coupled to a beam terminal, and wherein the arrangement of the array terminal and the beam terminal is characterized by a true time delay between the array terminal and the beam terminal, and a line coupled to the array terminal characterized by a line length such that there is an equal time delay for the path through the passive beamformer.

According to another embodiment, one or more layers of the multilayer package comprises at least one of a low-temperature co-fired ceramic material, a high temperature co-fired ceramic material, an aluminum nitride material; an alumina material, gallium arsenide, high resistivity silicon, silicon carbide, and an organic laminate material.

According to another embodiment, the cavity wall spacing is less than approximately one-tenth of the guided wavelength at the highest operating frequency.

According to another embodiment, the probe-to-probe spacing is approximately one-half of the guided wavelength at the highest operating frequency.

According to another embodiment, each probe of the plurality of capacitive probe feeds has a probe-to-via spacing proportional to the guided wavelength.

According to another embodiment, the probe-to-via spacing is approximately one-half of the guided wavelength at the highest operating frequency.

According to another embodiment, the passive beamformer includes a step-down ring disposed between a top surface of each probe feed of the plurality of probe feeds and the top plate, wherein the step-down ring is coupled to the top plate by one or more step-down ring vias.

According to another embodiment, a distance between the step-down ring and the top plate is proportional to the guided wavelength at the highest frequency.

According to another embodiment, the passive beamformer includes one or more power dividers that are coupled to two or more of the plurality of beam terminals.

According to another embodiment, the one or more power dividers are formed in the multilayer package.

According to another embodiment, the passive beamformer includes at least one or more transmit modules that are disposed in the multilayer package in a layer above the top plate.

According to another embodiment, the passive beamformer includes a mode suppressor coupled to the plurality of cavity wall vias and configured to minimize resonance in the plurality of cavity wall vias.

According to yet another embodiment a beamforming architecture includes a beamformer core with a plurality of beam ports and a plurality of array ports and control electronics coupled to the plurality of beam ports of the beamformer core with a plurality of feed lines, each feed line coupled to a beam port of the plurality of beam ports.

According to a further embodiment, the control electronics are configured to provide phase center control by varying an amplitude of a signal on one or more feed lines of the plurality of feed lines, wherein the beamformer core is configured to convert the phase center control into beam direction control at the plurality of array ports.

According to another embodiment, the control electronics further comprise a plurality of amplitude control channels coupled to the plurality of feed lines.

According to another embodiment, each amplitude control channel of the plurality of amplitude control channels includes a switch with an input and one or more outputs coupled to the one or more feed lines, wherein each of the one or more outputs of the switch is selectable to vary the one or more feed lines with the signal to adjust the phase center control, and an attenuator coupled to the input of the switch wherein the attenuator is configured to vary the amplitude of the signal to adjust the phase center control.

According to another embodiment, the control electronics further comprise one or more power dividers, each power divider having an input, a first output, and a second output, wherein the first output is coupled to a first amplitude control channel or an input to a second power divider and the second output is coupled to a second amplitude control channel or an input to a third power divider.

According to another embodiment, the control electronics include an RF input and an amplifier having an input coupled to the RF input and an output coupled to the one or more power dividers.

While several features are described herein with respect to embodiments of the invention, features described with respect to a given embodiment also may be employed in connection with other embodiments. The following description and the annexed drawings set forth certain illustrative embodiments of the invention. These embodiments are indicative, however, of but a few of the various ways in which the principles of the invention may be employed. Other objects, advantages, and novel features according to aspects of the invention will become apparent from the following detailed description when considered in conjunction with the drawings.

DETAILED DESCRIPTION

The present disclosure will describe a new wideband parallel plate lens multi-beamformer with vertical probes over a ground plane backing in an electrically sealed cavity shaped according to Rotman lens equations. Next, the disclosure will describe a low-cost, volume manufacturable fully passive true time delay (TTD) ultra-wideband (UWB) multi-beamforming compact parallel plate lens. Finally, the disclosure will describe an RF beamforming architecture that provides UWB continuous TTD for timed array beamsteering.

I. Wideband Parallel Plate Lens Multi-Beamformer

The present invention includes an RF multi-beamformer that overcomes the size, bandwidth, efficiency, and EMC/EMI limitations of conventional beamformers. Low-cost, high gain multibeam antenna arrays are a necessary component for achieving a high level of spatial multiplexing necessary to implement modern wireless networks such as massive multiple input multiple output (MIMO) systems. The embodiments described herein improve the wide-angle scan performance of feed ports of parallel plate wave conducting lenses by replacing conventional horn feeds with capacitive probes placed approximately one-half a guided wavelength from the cavity side wall at the highest frequency of operation. This feature also reduces the size and increases the bandwidth of the beamformer.

Figure 1:
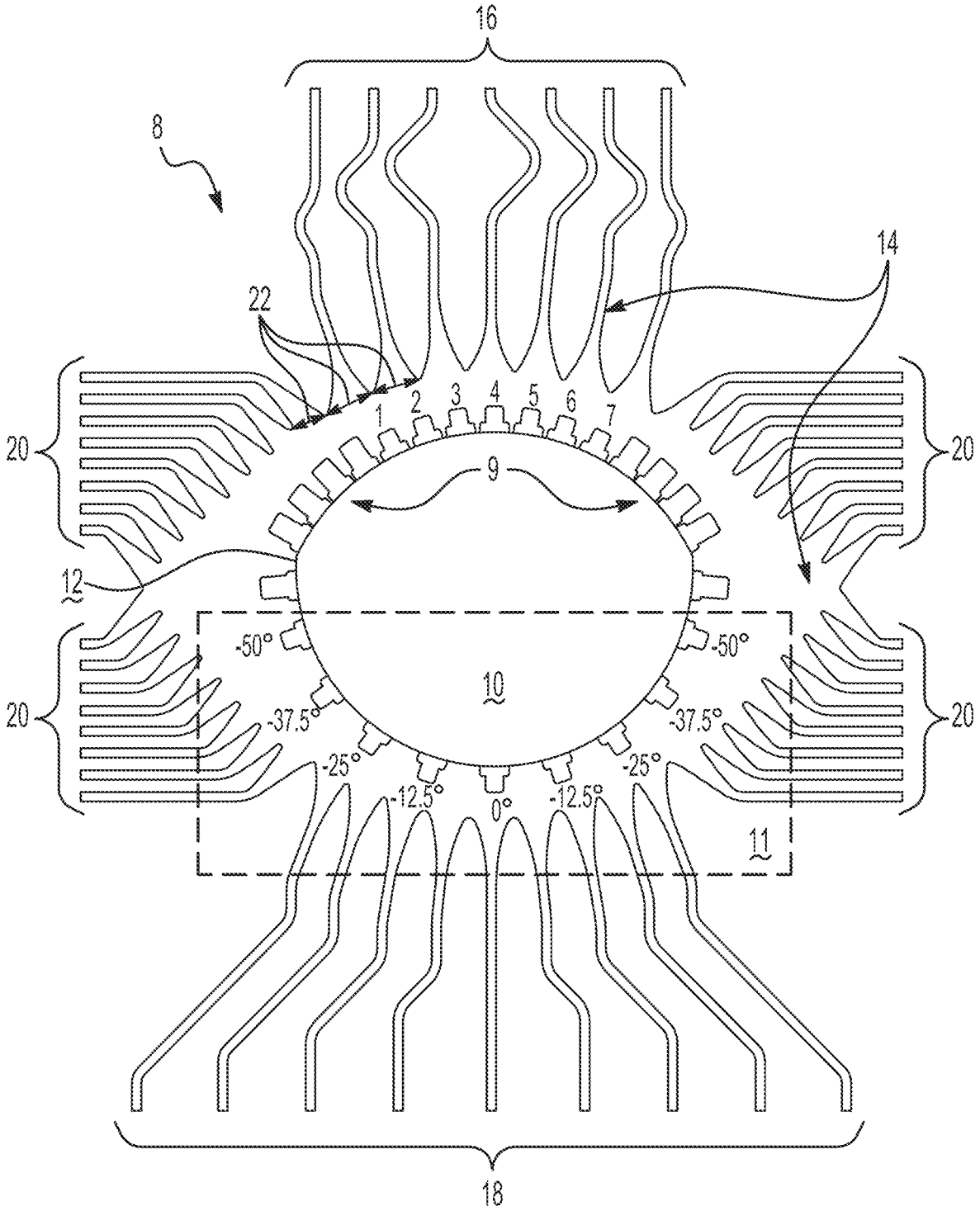
FIG. 1 shows a top-down view of a parallel plate lens multi-beamformer according to the present invention superimposed on a conventional microstrip lens with the same number of beam ports, array ports, scan angles, and bandwidth.

FIG. 1 shows a top-down view of a parallel plate lens multi-beamformer according to the present invention superimposed on a conventional microstrip lens with the same number of beam ports, array ports, scan angles, and bandwidth. As shown in FIG. 1, the parallel plate lens multi-beamformer 8 is a parallel plate wave conducting lens. The parallel plate wave conducting lens includes a top plate 10, a bottom plate (not visible in FIG. 1), a cavity side-wall 12 coupled to the top plate 10 and the bottom plate to form a sealed cavity for the parallel plate wave-conducting lens, and one or more connections coupled to the cavity side-wall 12. The top plate 10, the bottom plate, and the cavity side-wall 12 may be formed with any suitable conducting material such as metal or metal plated plastic formed by, for example, subtractive or additive manufacturing means. The one or more connections includes one or more array ports 1-7, one or more terminations 9, and one or more beam ports 11.

Also shown under the parallel plate lens multi-beamformer 8 in FIG. 1 is a conventional microstrip Rotman lens 14 that constitutes the current state-of-the-art. The conventional microstrip Rotman lens 14 includes a plurality of traces to carry signals including array traces 16, beam traces 18, and termination traces 20. The plurality of traces form horn-style beam and array port feeds. Each trace of the plurality of traces is characterized by a port width 22 that limits the bandwidth of the conventional microstrip Rotman lens 14. The conventional microstrip Rotman lens 14 design has been scaled to use the same substrate as the parallel plate lens multi-beamformer 8 (e.g., a commercial substrate such as Isola Astra® MT77) for fair size comparison.

To eliminate the size, bandwidth, efficiency, and EMC/EMI limitations of conventional microstrip Rotman lenses, the present invention provides the parallel plate lens multi-beamformer 8 within an electrically sealed metal cavity and a plurality of monopole-based feeds (described in detail below). The capacitive probe feeds on the input (beam side) may be tied together. The wider scan radiation and scattering properties of the probe feeds than the horn feeds allow for a shorter focal length and provide a smaller device. The shorter focal length and smaller device reduce the total number of terminations 9 on the parallel plate wave conducting lens compared to the number of terminations 20 on the microstrip lens 14. Because signal power is lost to each termination, the reduced number of terminations results in a multi-beamformer that loses less power to the terminations.

Figure 2:
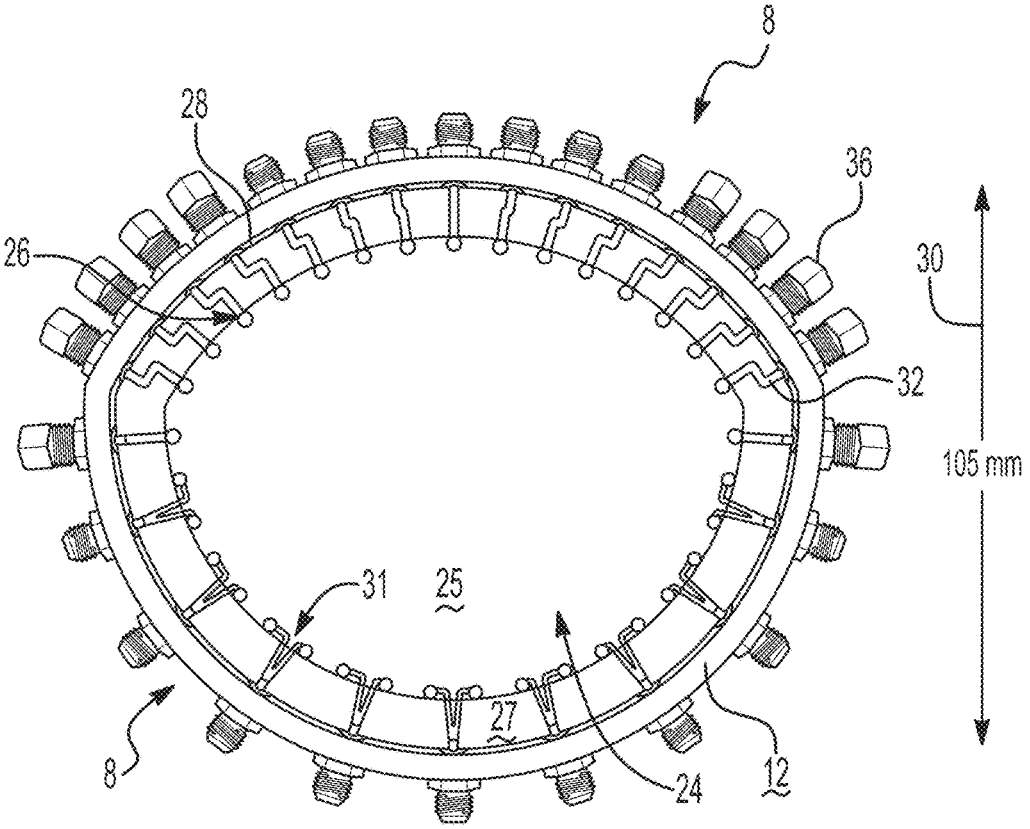
FIG. 2 shows an internal view of a cavity of the parallel plate lens multi-beamformer according to the present invention.

FIG. 2 shows an internal view of the cavity of the parallel plate lens multi-beamformer according to the present invention. To highlight key details, the top plate 10 is removed from the parallel plate lens multi-beamformer 8 to show a cavity 24 formed by the top plate 10, the bottom plate (not shown), and the cavity wall 12. The internal view of the parallel plate lens multi-beamformer 8 illustrates a plurality of capacitive probe feeds 26 disposed in an entire perimeter of a cavity 24 of the parallel plate lens multi-beamformer 8 to provide a plurality of monopole-based feeds. The cavity 24 may be filled with air, a dielectric, or a combination thereof. FIG. 2 shows a central dielectric region 25 characterized by a low-loss dielectric constant (Dk) and low dissipation factor (Df). In an exemplary embodiment, Dk may be less than or equal to 3 and Df may be less than or equal to 0.0017.

The plurality of capacitive probe feeds 26 may be disposed in the periphery of the central dielectric region 25. The cavity 24 may include a backing cavity 27 formed between the plurality of capacitive probe feeds 26 and the cavity wall 12. The dimensions of the backing cavity 27 may be proportional to the distance between the cavity wall 12 and the dielectric 25. In an exemplary embodiment, the dimensions may correspond to approximately one-half the guided wavelength within the cavity 24 of the parallel plate lens multi-beamformer 8 at the highest operating frequency of the multi-beamformer. The guided wavelength depends on the materials selected and the highest operating frequency. The guided wavelength may be equal to an operating wavelength when the backing cavity 27 is air-filled. The backing cavity 27 may be a dielectric or, preferably, it may be partially filled with a dielectric such that it would allow printing of microstrip transmission line sections that connect the coaxial connectors 36 to the capacitive probe feeds 26.

The plurality of capacitive probe feeds 26 form an array of probes backed by a ground plane 28 and the array of probes is capable of absorbing energy over much wider scan angles and frequencies than an array of horn feeds (tapered line launchers). The ground plane 28 may be formed using a via fence with via spacing corresponding to the operating wavelength of the parallel plate wave conducting lens. In an alternative embodiment, the cavity wall 12 is a conductive material and is the ground plane 28 for the parallel plate lens multi-beamformer 8. The array of capacitive probe feeds 26 may be designed with probe spacing set to one-half of the guided wavelength ($\lambda/2$) in the cavity for a specific operating frequency. In some embodiments, the specific frequency may be the highest frequency at which the device is designed to operate. The guided wavelength may be equal to an operating wavelength when the cavity is air-filled. The capacitive probe feeds 26 are disposed at a spacing interval corresponding to $\lambda/2$ along an entire perimeter of the cavity as shown in FIG. 2. The capacitive probe feeds 26 may form a concentric array with the cavity wall 12. Each capacitive probe feed 26 is coupled to an array port, a termination, or a beam port.

As described herein, a probe feed, e.g., a monopole, is surrounded by ground planes on three sides: the top plate 10, bottom plate, and the edge of the parallel plate lens region, e.g., ground plane 28 formed on the cavity wall 12. A transmission line 32 between the probe feed and edge of the cavity 24 is used as an impedance transformer. Properties such as line length of the transmission line 32 may be configured to be a specific impedance to achieve a broadband match. The cavity 24 formed by the top plate 10, bottom plate, and cavity wall 12 may be a constrained lens such as a Rotman lens, a Ruze lens, an R-kR lens, an R-2R lens and the like. The capacitive probe feeds 26 may be incorporated into any suitable constrained lens.

Once a probe element with acceptable impedance bandwidth has been designed, the elements can be placed into the cavity 24 shaped by constrained lens equations such as the Rotman lens equations. The area between the capacitive probe feeds 26 and edge of the cavity provides room to integrate the Rotman lens line-length parameter, w, into the transmission line connecting the capacitive probe feeds 26 to the coaxial connectors 36, as well as power dividers 31 on the beam port side. The power dividers may be Wilkinson dividers, Gysel dividers, active dividers, and the like. The plurality of capacitive probe feeds 26 enables use of a shorter lens focal length, further decreasing the physical dimensions of the lens while also reducing the number of terminations required compared to conventional beamformers. For example, an on-axis length 30 of the multi-beamformer in FIG. 2 may be 105 mm for a parallel plate wave conducting lens with an operating frequency of 10.6 GHz. In an alternative embodiment, not shown, the capacitive probe feeds 26 on the beam port side may be coupled directly to a beam port and the power combiners/dividers may be outside the parallel plate wave conducting lens.

Figure 3:
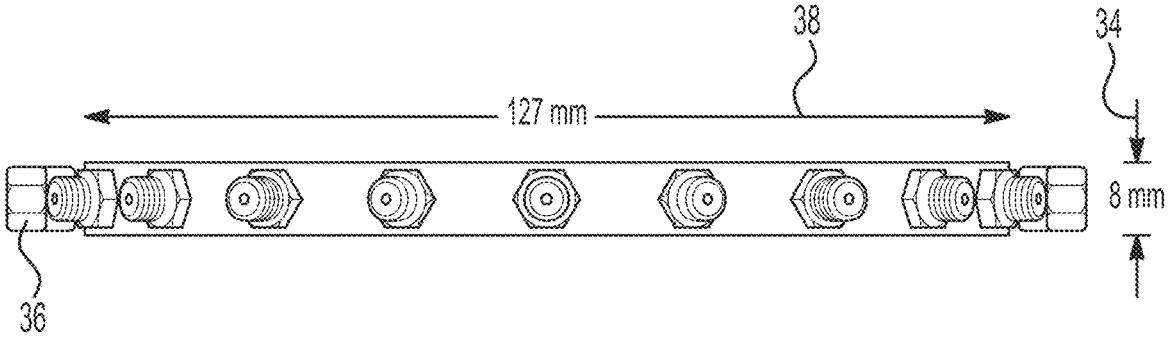
FIG. 3 shows an elevation view of the parallel plate lens multi-beamformer according to the present invention.

FIG. 3 shows an elevation view of the parallel plate lens multi-beamformer according to the present invention. An overall thickness 34 of the multi-beamformer is driven by the guided wavelength. For example, the overall thickness 34 may be approximately one tenth of a wavelength at the highest frequency of operation. In FIG. 3, the thickness is limited by the size of an SMA connector 36. In a specific embodiment, the thickness of the parallel plate lens multi-beamformer with an operating frequency of 10.6 GHz may be as thick as 2.66 mm if not for SMA connectors coupled to the lens. A width 38 perpendicular to the on-axis length of the parallel plate lens multi-beamformer is proportional the number of array elements and input beams that the parallel plate lens multi-beamformer feeds. In FIG. 3, the width may be 127 mm for the parallel plate lens multi-beamformer with the operating frequency of 10.6 GHz.

Figure 4:
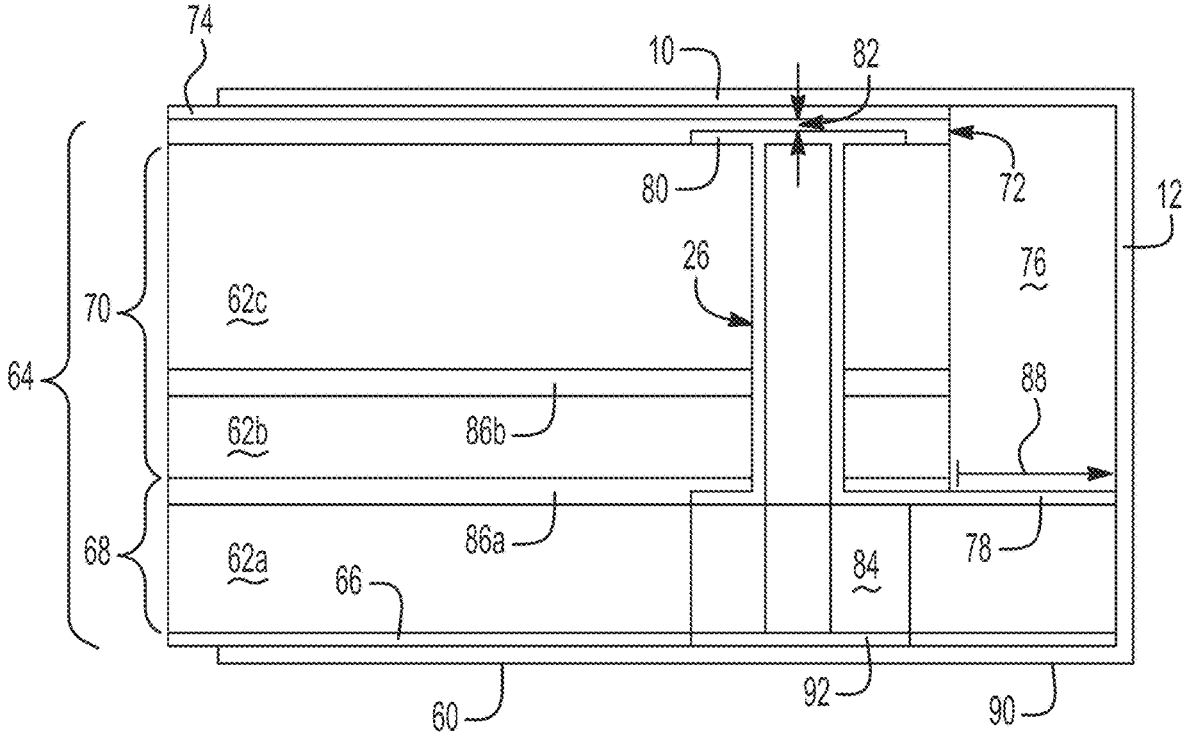
FIG. 4 shows a cross-sectional view of a given probe feed within the parallel plate lens multi-beamformer according to an embodiment of the present invention.

FIG. 4 shows a cross-sectional view of an exemplary probe feed within a parallel plate lens multi-beamformer according to an embodiment of the present invention. The cross-sectional view shows a portion of the top plate 10, the bottom plate 60, and the cavity wall 12 of the sealed metal cavity 24 of the parallel plate lens multi-beamformer. According to this embodiment, the capacitive probe feeds 26 may be formed in a dielectric material 62 using conventional printed circuit board (PCB) techniques. The PCB section 64 shown in FIG. 4 includes a bottom conducting layer 66, a first dielectric portion 68, a second dielectric portion 70, a third dielectric portion 72, a top conducting layer 74, the probe feed 26, a backing cavity 76 and a printed feed line 78. In alternative embodiments, the dielectric portions 68, 70, 72 may comprise multiple layers. The bottom conducting layer 66 and the top conducting layer 74 may be coupled to the ground plane 28 described in FIG. 2. The ground plane may be a via fence, a conductive cavity side-wall, or a combination thereof.

The probe feed 26 includes a cap 80. The cap 80 may be any geometric shape to provide a desired capacitance between the top conducting layer 74 and the probe feed 26 to optimize impedance matching in the parallel plate conducting lens. The shape may be a circular cap. A distance 82 between the cap 80 and the top conducting layer 74 may be configured to provide a specific capacitance between the top conducing layer 74 and the probe feed 26. In another embodiment, a ring may be formed the distance 82 over the caps 80 of the plurality of probe feeds and the ring may be coupled to the top conducting layer 74. The probe feed 26 is coupled to the printed feed line 78 that is coupled to a port to transmit and/or receive a signal. Although not shown, the probe feed 26 may be coupled to one or more additional probe feeds to form the desired number of inputs and outputs. The probe feed may be formed using a plated through via that is separated from the bottom conducting layer 66 by a back-drilled area 84. The bottom conducting layer 66 is coupled to the bottom conducting plate 60 and the top conducting layer 74 is coupled to the top conducting plate 10.

The first dielectric portion 68, the second dielectric portion 70, and the third dielectric portion 72 may be formed using any suitable dielectric material 62 (e.g., Isola Astra® MT77 with a dielectric performance of Dk=3.00 and Df=0.0017. The dielectric material 62 may be formed in one or more layers. The layers may include one or more of polymer, organic PCB, thin-film, low-temperature co-fired ceramic, high temperature co-fired ceramic, and the like. The first dielectric portion 68, the second dielectric portion 70, and the third dielectric portion 72 may be separated by one or more layers 86. For example, the first dielectric portion 68 may include a layer of dielectric material 62*a* that is 20 mil thick. The first dielectric portion 68 and the second dielectric portion 70 may be separated by a first layer 86*a* of high-performance epoxy laminate and prepreg such as Isola FR406, characterized by a dielectric performance of Dk=3.93 and Df=0.0167. The second dielectric portion 70 may include a first layer 62*b* of dielectric material 62 that is 20 mil thick, an intermediate layer 86*b* of high-performance laminate such as Isola 370HR characterized by a dielectric performance of Dk=4.04 and Df=0.0210 and a second layer 62*c* of dielectric material 62 that is 60 mil thick. The third dielectric portion 72 may be another layer of high-performance laminate. One of ordinary skill in the art would recognize many variations, modifications, and alternatives.

The PCB section 64 shows the backing cavity 76 formed between the second dielectric portion 70 and the cavity wall 12. The backing cavity 76 may be air or another dielectric material. If the backing cavity 76 is a material other than air, the material fills the backing cavity to a height equal to or higher than the cap 80 of the probe feed 26. The distance between the probe feed 26 and the cavity wall 12 may be characterized by a cavity depth 88. The cavity depth 88 depends on the operating frequency and the dielectric material. The cavity depth 88 is not necessarily shown to scale in FIG. 4.

Each capacitive probe feed 26 may be positioned at a distance from the cavity wall corresponding to approximately one-half a guided wavelength ($\lambda/2$) at the highest frequency of operation. The guided wavelength may be equal to an operating wavelength when the backing cavity is air-filled.

Although not shown, in FIG. 4, the printed feed line 78 may be configured as an impedance transformer to achieve a broadband match. The printed feed line 78 may be coupled to an array port, a beam port, a termination, and/or another printed feed line. In an alternative embodiment, the printed feed line 78 may extend to a bottom surface 90 of the parallel plate wave conducting lens to form a no-lead package that may be integrated into another board. The bottom conducting layer may include insulated regions 92 which the feed line 78 may pass through. The printed feed line 78 may be configured to form a combiner/divider with one or more adjacent probe feeds. The combiner/divider may be a passive combiner/divider such as a Wilkinson divider, a Gysel divider, etc. or an active combiner/divider that includes a low-noise amplifier (LNA) or power amplifier (PA).

Figure 5:
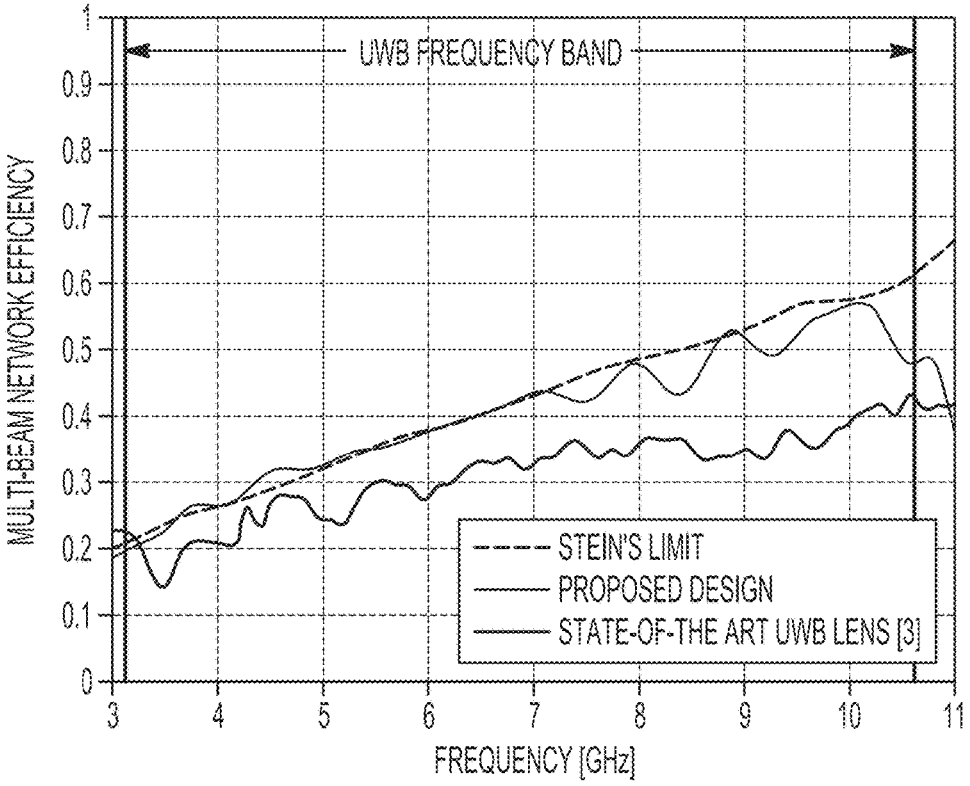
FIG. 5 shows a graph of beamforming network efficiency of the parallel plate lens multi-beamformer according to the present invention.
Figure 6:
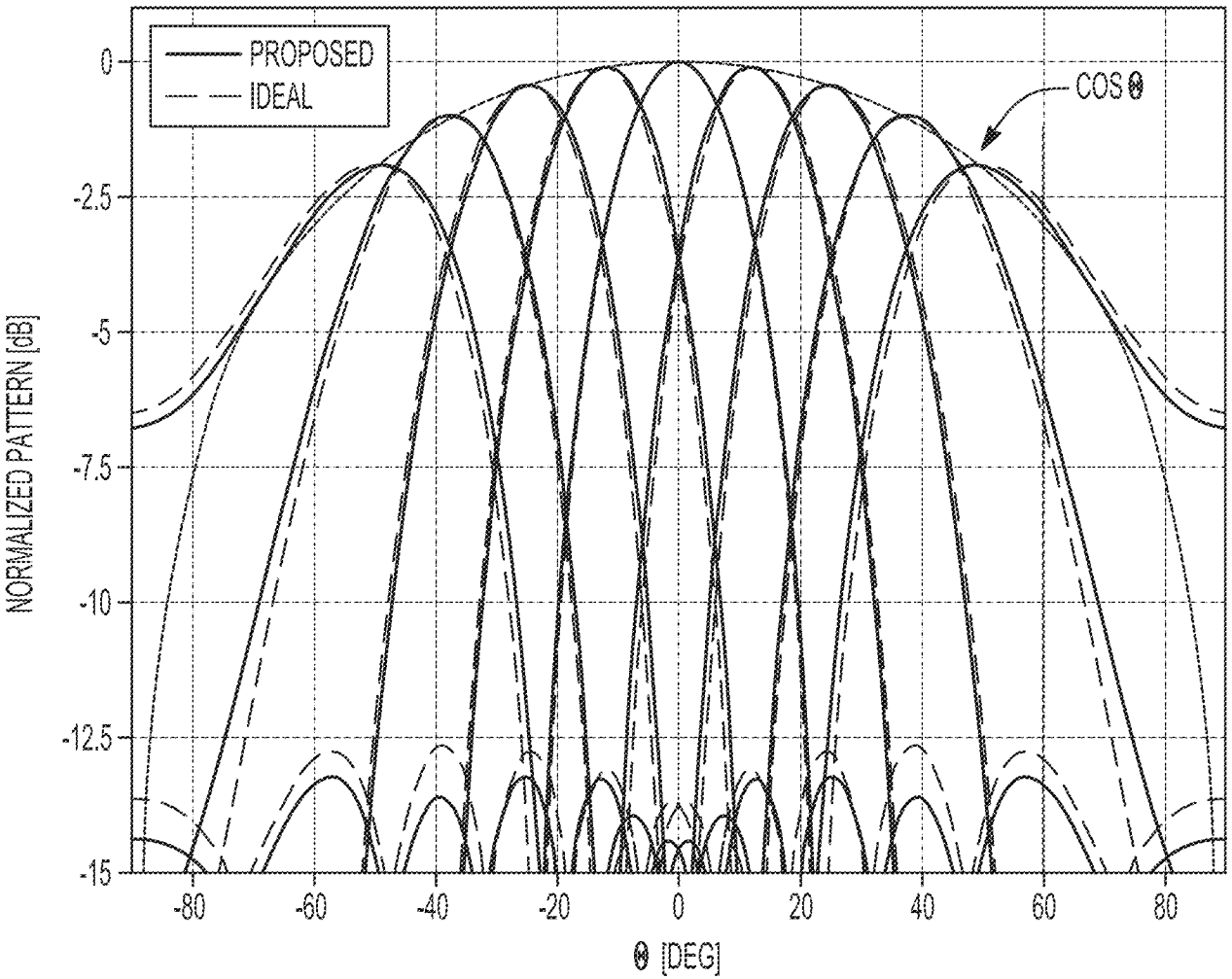
FIG. 6 shows a graph of normalized beam patterns at 7 GHz formed by the parallel plate lens multi-beamformer according to the present invention.

Performance of an embodiment of a multi-beamformer in accordance with the present invention is shown in FIGS. 5 and 6 using a full-wave high-frequency structure simulator.

FIG. 5 shows a graph of beamforming network efficiency of the parallel plate lens multi-beamformer according to the present invention. One of the most important figures-of-merit (FoM) in a passive RF beamformer is its efficiency, $e_k=\Sigma_i|S_{A_i,B_k}|^2$. Broadside beam efficiency of the parallel plate lens multi-beamformer and a conventional microstrip Rotman lens are plotted versus frequency and compared with Stein's efficiency limit in FIG. 5. The conventional microstrip Rotman lens is shown as the "state of the art UWB Lens [3]" in FIG. 5. The parallel plate lens multi-beamformer operates near the Stein's efficiency bound over the entire band 3.1-10.6 GHz. The efficiency monotonically increases from 20% to 55% at the high end of the band.

The parallel plate lens multi-beamformer shown in FIGS. 1-4 provides improved efficiency when compared to conventional devices with high beam coupling resulting from the large number of beams and small array size. Although not shown, the efficiency of the parallel plate lens multi-beamformer shown in FIGS. 1-4 remains higher than the efficiency of conventional devices as scan angle changes.

FIG. 6 shows a graph of normalized beam patterns at 7 GHz formed by the parallel plate lens multi-beamformer according to the present invention. The second most important FoM is beam fidelity. FIG. 6 plots the normalized patterns of all beams produced by the multi-beamformer shown in FIGS. 1-4 when it feeds a 7-element linear array of isotropic sources separated by a distance, $d=\lambda/2$, at 10.6 GHz. Patterns are compared to the ideal beams formed with uniform amplitude and progressive phase excitation. Beam patterns are normalized to the peak of the center beam. Close agreement between the formed beams and ideal reference in terms of beam pointing direction, beam widths, and side lobe level (SLL) show that amplitude and phase errors are very small. Excellent scan performance is observed over the design bandwidth, as expected from a true-time-delay beamformer.

II. Compact Ultrawideband Parallel Plate Lens Multi-Beamformer Core

The present disclosure describes a low-cost, volume manufacturable fully passive TTD UWB multi-beamforming compact parallel plate lens designed as a multilayer package such as a solder mountable LTCC package, with Quad Flat No-lead (QFN) style pin layout along with a parallel plate lens beamforming network. This allows for modular, simpler fully planar integration of RF front ends.

Figure 7:
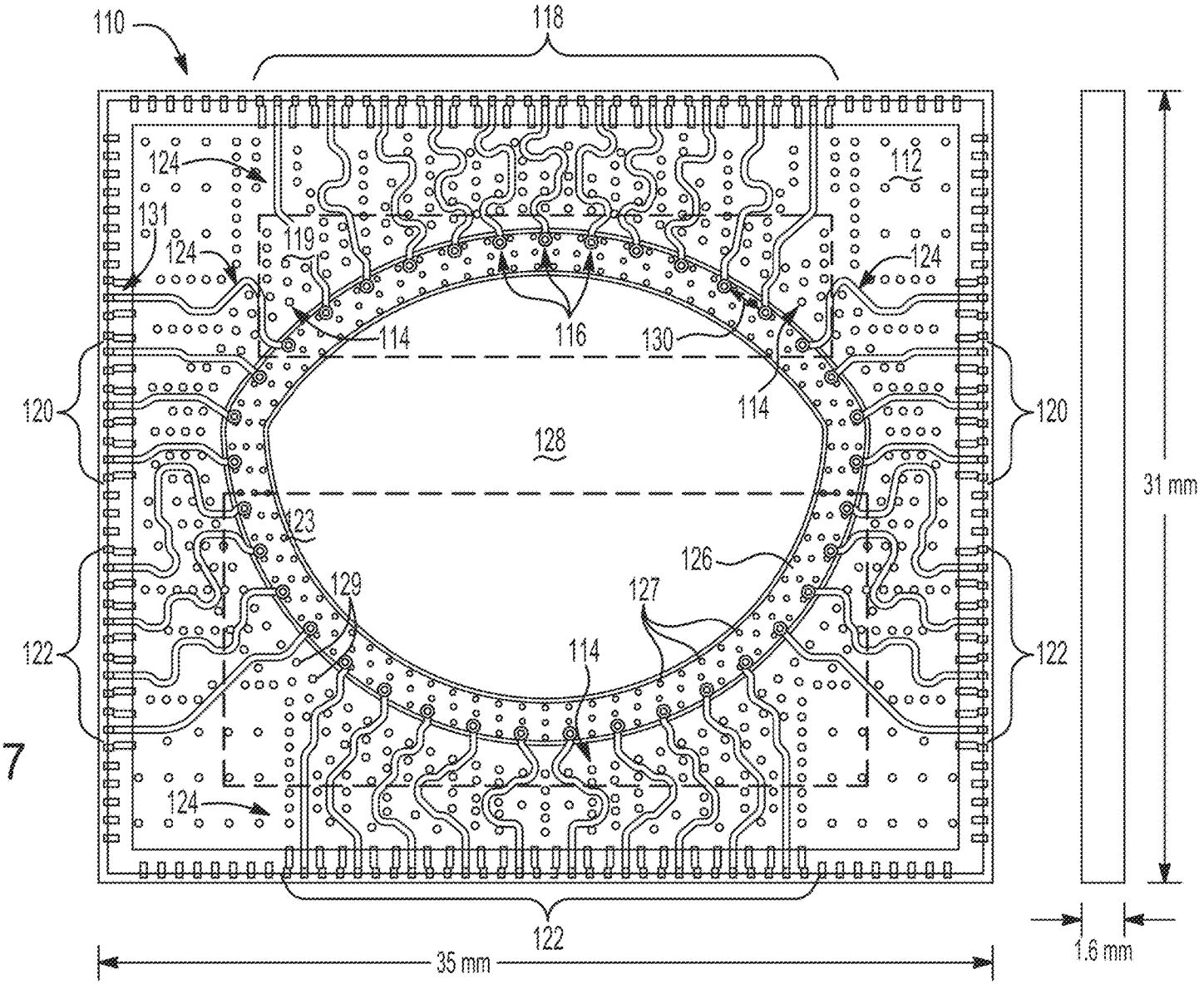
FIG. 7 shows a top-down view of a compact ultrawideband parallel plate lens multi-beamformer core according to the present invention.

FIG. 7 shows a top-down view of a compact UWB parallel plate lens multi-beamformer core according to the present invention. The compact parallel plate lens multi-beamformer is formed in a multilayer package 110. The multilayer package 110 includes all the elements necessary to form a parallel plate wave conducting lens in accordance with design requirements for a constrained lens such as a Rotman lens, a Ruze lens, an R-kR lens, an R-2R lens and the like. The multilayer package 110 includes a top plate (not shown), a bottom plate 112, a plurality of cavity wall metallic (plated) vias 114, a plurality of capacitive probe feeds 116, a plurality of array terminals 118, a plurality of dummy load terminations 120, a plurality of beam terminals 122, a plurality of lines 124, and a step-down ring 126. The multilayer package may be formed using any suitable process such as a low-temperature co-fired ceramic process, a high temperature co-fired ceramic process, a GaAs process, a high resistivity Si with through silicon via (TSV) process, an organic PCB build-up with or without sintering process, and the like. The multilayers may be formed using one or more suitable materials such as a low-temperature co-fired ceramic material, a high temperature co-fired ceramic material, an aluminum nitride material; an alumina material, gallium arsenide, gallium nitride, high resistivity silicon, silicon carbide, an organic laminate material, and the like.

The top plate and the bottom plate 112 may be formed using any suitable material for a parallel plate wave conducting lens. One or more layers of the multilayer package 110 may include a metal material to form the top plate and the bottom plate 112. A lens cavity 128 may be defined by the plurality of cavity-wall metallic vias 114. The plurality of cavity wall metallic vias 114 may be formed in one or more layers of the multilayer package 110 to define the cavity 128 for a parallel plate wave conducting lens such as the compact ultrawideband parallel plate lens multi-beamformer core described herein. A shape of the lens cavity 128 may be determined using constrained lens equations such as Rotman lens, Ruze lens, R-kR lens, R-2R lens equations and the like. The cavity wall metallic vias 114 may have a cavity wall spacing 129 proportional to the guided wavelength at the highest operating frequency of the device. The cavity wall spacing may be less than or equal to one-tenth of the guided wavelength at the highest operating frequency. In some embodiments, the cavity wall spacing may be less than one-twentieth of the guided wavelength of the device. The cavity wall metallic vias 114 are coupled to the top plate and the bottom plate 112 of the compact parallel plate lens multi-beamformer. The cavity wall metallic vias 114 are formed using any suitable conductive material. A mode suppressor 160 (shown in FIGS. 9 and 10) may be coupled to one or more of the cavity wall metallic vias 114. In some embodiments, the mode suppressor 160 may be coupled to a plurality of the cavity wall metallic vias 114 to form an outer ring around the cavity 128.

The plurality of capacitive probe feeds 116 are disposed throughout the periphery of the lens parallel plate region to transmit and receive electronic signals. The capacitive probe feeds 116 are monopole feeds in the compact parallel plate lens multi-beamformer and are also formed as buried metallic vias with a capacitive pate disposed on top. A probe to probe spacing 130 between the capacitive probe feeds is proportional to the guided wavelength at the highest operating frequency. The probe to probe spacing may be substantially equal to one-half the guided wavelength at the highest operating frequency. The arrangement of the capacitive probe feeds 116 coupled to the array terminals 118 and the beam terminals 122 is in accordance with constrained lens equations to provide a parallel plate wave conducting lens with a true-time delay (TTD).

A first subset of capacitive probe feeds 119 is coupled to the plurality of array terminals (leads) 118 on an edge of the package 110 via corresponding lines 124. A second subset of the capacitive probe feeds 123 is coupled to the plurality of beam terminals 122 on the edge of the package 110, via corresponding lines 124, and the remaining capacitive probe feeds 116 are coupled to the plurality of terminals that are coupled to dummy load terminations 120 that reside external to the package. In some embodiments, a length of each line 124 coupling the dummy load terminations 120 to a respective probe feed 116 and a length of each line 124 coupling the beam terminals 122 to a respective probe feed 116 are equal. A length of each line 124 coupling the array terminals 118 to a respective probe feed 116 may be formed to have a length that corresponds to a line length, w, defined by an appropriate constrained lens equation. In some embodiments, the length of each line 124 may be configured for an impedance match with the parallel plate lens. Each line 124 of the plurality of lines may be coupled to a coplanar waveguide transition 131. The coplanar waveguide transitions 131 may be coupled to the terminals of the multilayer package 110. And the terminals may be coupled to a printed circuit board using a ball grid array, a land grid array, or other suitable package arrangement.

In some embodiments, multilayer package 110 of the compact parallel plate lens multi-beamformer may include the step-down ring 126. The step-down ring 126 is coupled to the top plate using a plurality of step-down metallic vias 127. The shape of the step-down ring 126 is determined using constrained lens equations. The step-down ring 126 is spaced from the probe feeds 116 proportional to the guided wavelength. The step-down ring 126 is spaced from the top plate proportional to the guided wavelength. The probe feeds 116 may include a capacitive cap to improve reception and transmission of signals.

The multilayer package 110 with the compact parallel plate lens multi-beamformer may include one or more additional layers or structures disposed above the top plate. The additional layers may include insulating layers, heat sink structures, power combiners/dividers, amplifiers, transmit/receive modules, and the like.

In a specific embodiment operating over 10-30 GHz, the overall dimensions of the package in FIG. 7 are 31 mm L×35 mm W×1.6 mm H ($3\lambda_{high}\times3.5\lambda_{high}\times0.15\lambda_{high}$, where $\lambda_{high}$ is the highest operating frequency). The multilayer package shown in FIG. 7 may use a low-temperature co-fired ceramic (LTCC) such as Kyocera's ® GL331. The multilayer package may be formed using 16 layers and following the associated design rules. The line lengths, w, are determined using the Rotman lens equations and are included on the LTCC package and the appropriate lengths have been added to all beam traces such that there is equal time delay for all paths through the lens. The top plate, bottom plate 112, cavity wall vias 114, and capacitive probes 116 required to form the parallel plate lens may be formed using one or more layers of the multilayer package and the parallel plate lens does not rely on an air cavity behind the probes to achieve wide bandwidth. Forming the lens in a multilayer design makes the parallel plate lens multi-beamformer even more compact and suitable for simpler manufacturing versus conventional constrained lens techniques.

Figure 8:
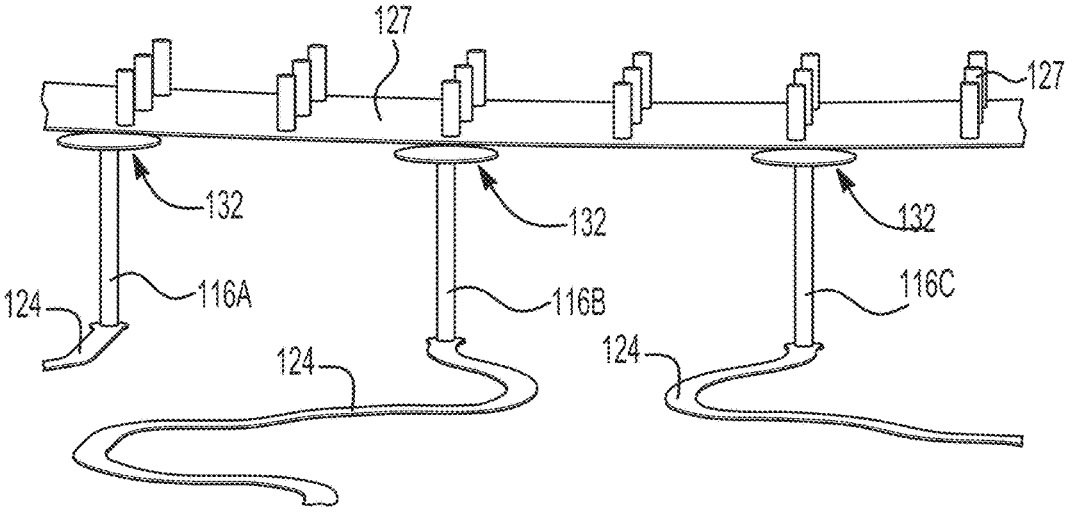
FIG. 8 shows a perspective view of a portion of the compact parallel plate lens multi-beamformer according to the present invention.

FIG. 8 shows a perspective view of a portion of the compact parallel plate lens multi-beamformer according to the present invention. The perspective view shows the step-down ring 126, capacitive probes 116, and lines 124 of the multilayer package 110. The step-down ring 126 is coupled to the top plate using a plurality of step-down metallic vias 127. The spacing between the top plate and the step-down ring 126 is proportional to the guided wavelength of the device at the highest operating frequency. Each capacitive probe feed 116A, 116B, and 116C is coupled to a respective line 124. The height of the probe feed 116A, 116B and 116C, as well as the height and width of the step-down ring 126 are determined to expand bandwidth, increase efficiency, and improve matching level based on application specific requirements. The capacitive probe feeds 116A may include a capacitive cap 132 to improve the efficiency and TTD of the system. The spacing between the capacitive cap 132 and the step-down ring 126 and the size and shape of the capacitive cap 132 are determined based on bandwidth, efficiency, and matching level requirements of the specific application. The capacitive probe feed 116A, 116B and 116C are positioned approximately one-half wavelength at the highest operating frequency from the metallic vias 114 that form the cavity 128. This type of wideband transition from a conventional microstrip or stripline lens to a parallel-plate waveguide can be used in many other applications including radial power combining networks, antennas, etc.

Figure 9:
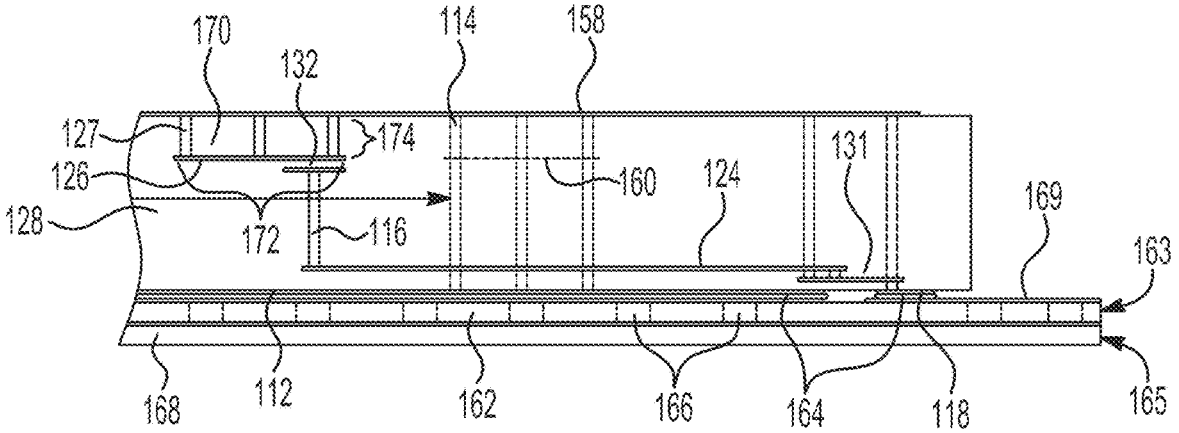
FIG. 9 is a cross-sectional view of a portion of a compact ultrawideband parallel plate lens multi-beamformer core according to the present invention.

FIG. 9 is a cross-sectional view of a portion of a compact ultrawideband parallel plate lens multi-beamformer core according to the present invention. The cross-sectional view shows a portion of the multilayer package 110 including the top plate 158, the bottom plate 112, a capacitive probe feed 116 with cap 132, the step-down ring 126 and associated metallic vias 127, the cavity wall metallic vias 114, a mode suppressor 160 coupled to the cavity wall metallic vias 114, a line 124, a coplanar waveguide transition section 131 and a terminal such as an array terminal 118. The multilayer package 110 may be coupled to an organic PCB 162 using soldered terminals 164. The PCB 162 may include a first layer 163 in which grounding and thermal vias 166 are coupled to a ground plane 168 and a second layer 165 to provide structural support. The PCB 162 includes grounded coplanar wave guides 169 coupled to, for example, the array terminal 118.

The cavity wall metallic vias 114 may be coupled together using the mode suppressor 160. The mode suppressor 160 may be formed in the same layer as the step-down ring 126. The mode suppressor 160 is coupled to a plurality of the cavity wall metallic vias 114 forming an outer ring around the cavity 128. The mode suppressor 160 is configured to suppress resonance in the cavity wall metallic vias 114. One of skill in the art may determine the appropriate dimensions of the mode suppressor 160 depending on the application and desired performance.

The step-down ring 126 and metallic vias form a broadband matching section 170. The step-down ring 126 of the broadband matching section may have a width 172 and a distance 174 from the top plate 158. The distance 174 is proportional to the guided wavelength at the highest operating frequency and may be approximately one-half the guided wavelength at the highest operating frequency in some embodiments. The width 172 and the distance 174 may be adjusted to control various properties of the compact ultrawideband parallel plate lens multi-beamformer core such as bandwidth, reflection coefficient, efficiency, and the like. One of skill in the art may determine the appropriate dimensions of the broadband matching section 170 depending on the application and desired performance.

Figure 10:
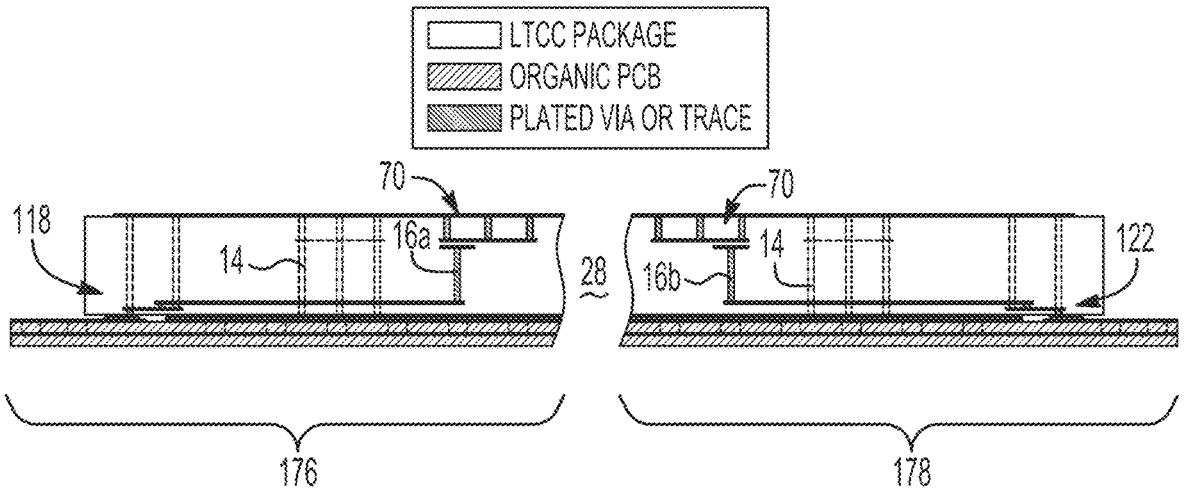
FIG. 10 is a cross-sectional view of an array port side and a beam port side of a compact ultrawideband parallel plate lens multi-beamformer core according to the present invention.

FIG. 10 is a cross section view of an array port side 176 and a beam port side 178 of a compact ultrawideband parallel plate lens multi-beamformer core according to the present invention. The expanded cross section view shows a first capacitive probe feed 116*a* coupled to an array terminal and a second capacitive probe feed 116*b* coupled to a beam terminal. The broadband matching section 170 and the cavity wall metallic vias 114 and associated mode suppressor are shown on each side of the cavity 128 of the compact ultrawideband parallel plate lens multi-beamformer core.

Figure 11:
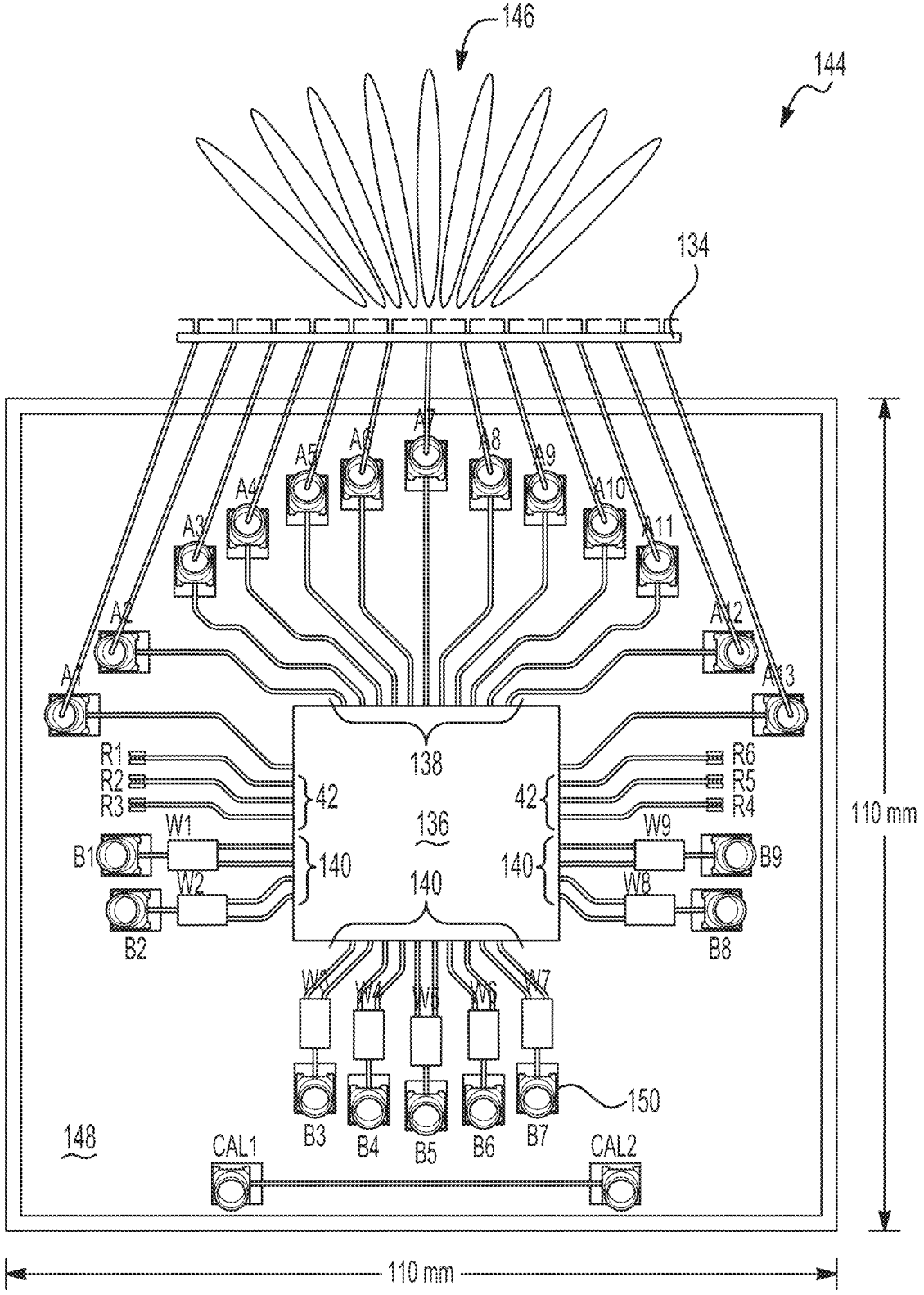
FIG. 11 shows a system for feeding an element row of a 2D antenna array with the compact ultrawideband parallel plate lens multi-beamformer and external power dividers/combiners according to the present invention.

FIG. 11 shows a system for feeding an element row of a 2D antenna array with the parallel plate lens multi-beamformer core and external power dividers/combiners according to the present invention. The system 134 includes a compact constrained lens multi-beamformer package 136 with array feed leads 138, beam connector leads 140, and dummy load termination leads 142 mounted on a PCB 148. The array feed leads 138 are coupled to 13 antenna array connectors A1-A13 that feed a 13-element antenna array 144. The beam connector leads 140 are coupled to 9 power divider/combiners W1-W9. Each of the power divider/combiners may be a Wilkinson divider, a Gysel divider, etc. or an active combiner/divider that includes a low-noise amplifier (LNA) or power amplifier (PA). One of ordinary skill in the art would recognize many variations, modifications, and alternatives.

Each beam connector lead 140 may be coupled to two or more capacitive probe feeds (not shown) inside the multi-beamformer package 136. The power divider/combiners W1-W9 are each coupled to a beam connector B1-B9 to rout RF energy through the system 134. The dummy load termination leads 142 are coupled to resistors R1-R6 to dissipate energy associated with the leads. The present invention enables a lower number of dummy load terminations when compared to the prior art, which results in lower losses and higher efficiency without deterioration in beam quality or time-domain pulse quality. The compact parallel plate lens multi-beamformer package 136 causes a TTD of the routed RF energy and the system transmits one or more beams 146.

In a specific embodiment the system shown in FIG. 11 includes the multilayer package 136 with an ultra-wideband mmWave massive MIMO beamformer mounted on a PCB 148 such as a custom evaluation Rogers® R04350 with mini-SMP connectors 150. The 13-element antenna array 144 that this device feeds is illustrated above the board. The 9 beam connectors B1-B9 may rout to resistive power combiners/dividers W1-W9 (e.g., a Marki® PD-0530SMG) mounted on the PCB 148 external to the multilayer package 136. The beam connectors B1-B9 are attached to the beamformer core inputs via the resistive power combiners/dividers W1-W9. In alternative embodiments, the dividers W1-W9 could be incorporated via printed restores within the multi-beamformer package 136. The dividers may be incorporated in the package 136 without affecting its size.

The system presented in FIG. 11 is suitable for modular measurements and testing, and to make the presentation of the invention easier. In practice much higher levels of integration may be used. For example, power combiner/dividers W1-W9 may be formed in one or more layers of the multilayer package 136 separate from the compact parallel plate lens multi-beamformer.

Performance of the embodiment of the compact ultra-wideband parallel plate lens multi-beamformer is shown below in FIGS. 12-14 using a full-wave high-frequency structure simulator (at a higher frequency range than FIGS. 5 and 6).

Figure 12:
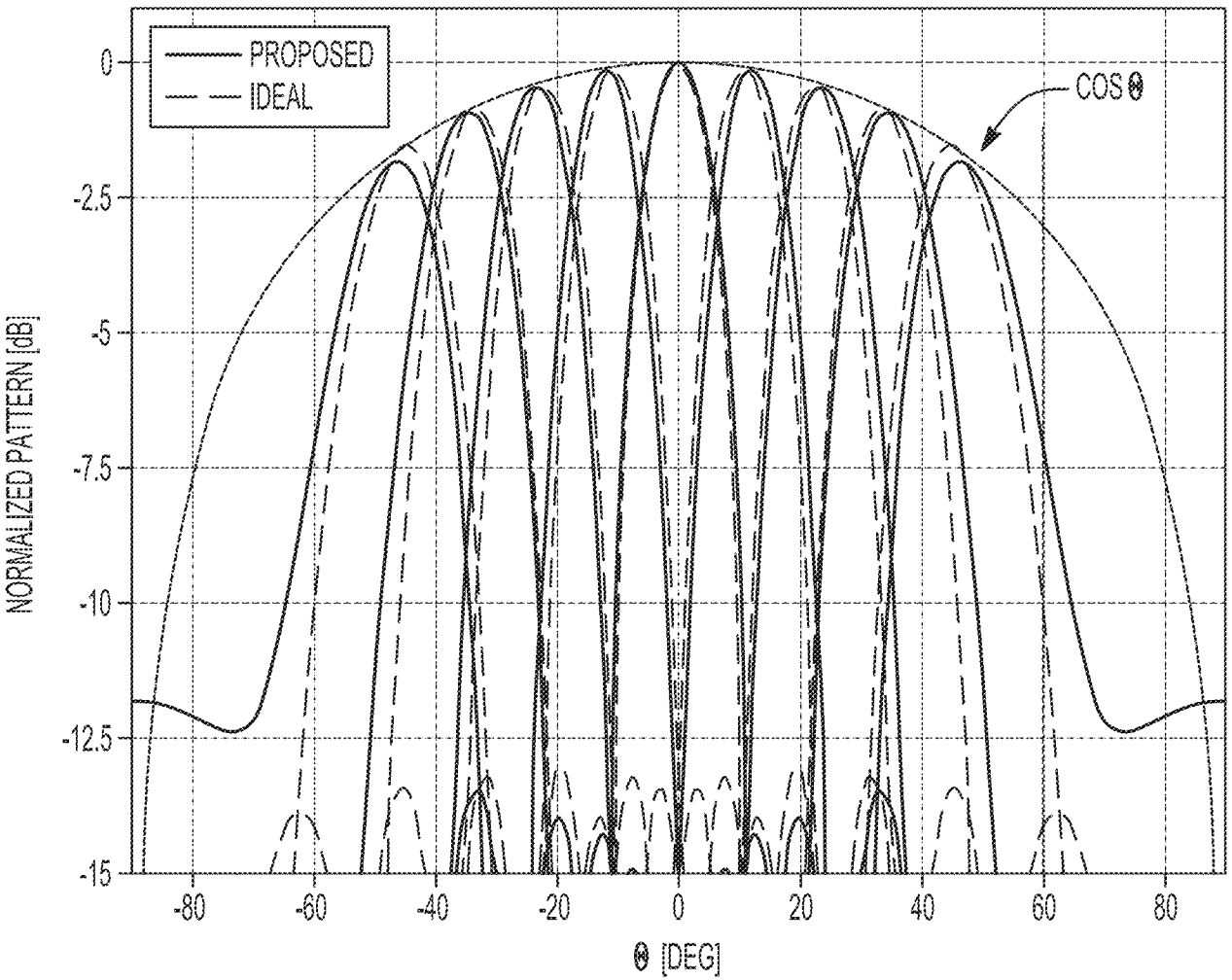
FIG. 12 shows a graph of normalized beam patterns at 20 GHz formed by the compact ultrawideband parallel plate lens multi-beamformer according to the present invention.

FIG. 12 shows a graph of normalized beam patterns at 20 GHz formed by the compact ultrawideband parallel plate lens multi-beamformer according to the present invention. FIG. 12 plots the normalized patterns of all nine beams produced by the beamformer when feeding a 13-element linear array of isotropic radiators separated by a distance, $d=\lambda_{high}/2$ (half wavelength at 30 GHz). Patterns are compared to "ideal" beams generated by coefficients for uniform amplitude distribution and linear phase progression, showing excellent agreement. Being a quasi-optical device, beam pointing direction remains nearly constant throughout the 10-30 GHz frequency band. Some RF reflection and coupling errors do appear at the widest scan angle (+/−80°), showing up as raised outer side lobes.

Figure 13:
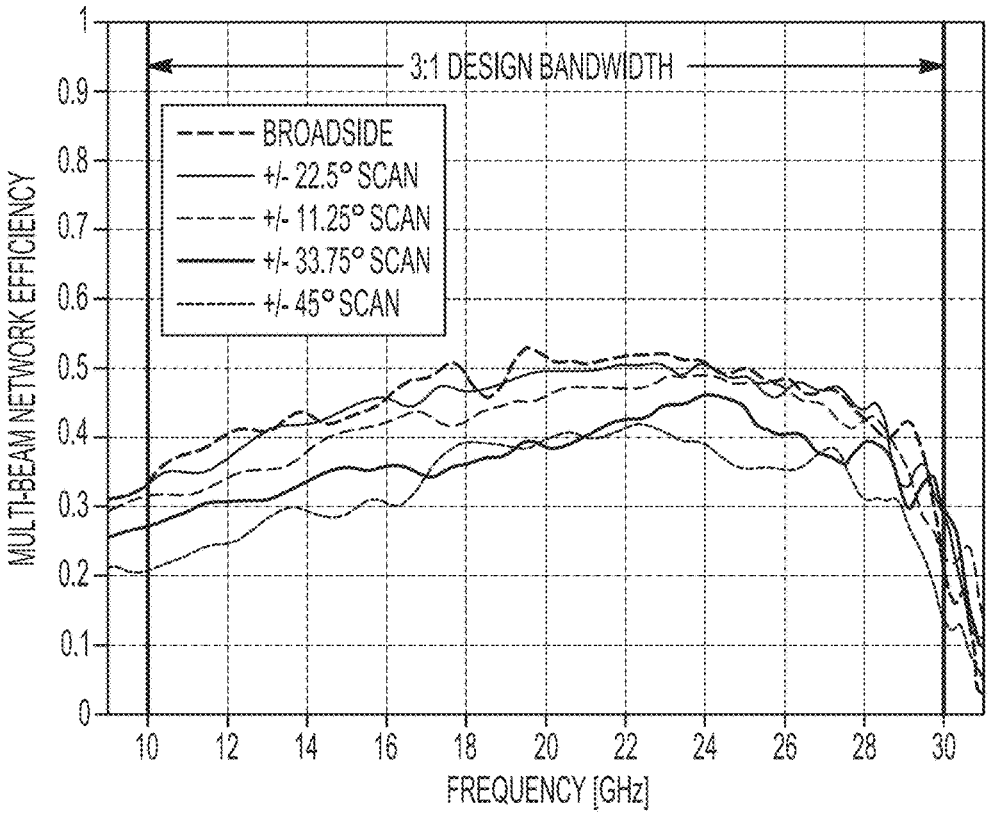
FIG. 13 shows a graph of beamforming network efficiency of the compact ultrawideband parallel plate lens multi-beamformer according to the present invention.

FIG. 13 shows a graph of beamforming network efficiency of the compact ultrawideband parallel plate lens multi-beamformer according to the present invention. Multi-beamforming efficiency is another important figure-of-merit (FoM) for passive networks. Efficiency of the beamformer at various scan angles versus frequency for all nine beams is shown in the graph. This represents the total excess loss from each beam port to the sum of all array ports and includes simulated loss of solder transitions and the external COTS restive combiners. Broadside efficiency begins at 30% at the lowest frequency, 10 GHz, and rises until hovering near 50% between 18-26 GHz. Above 28 GHz losses become more significant, though efficiency remains above 20% through 30 GHz. Because this is a quasi-optical device, losses increase for beams away from broadside, most notably on the widest two scan angles.

Figure 14:
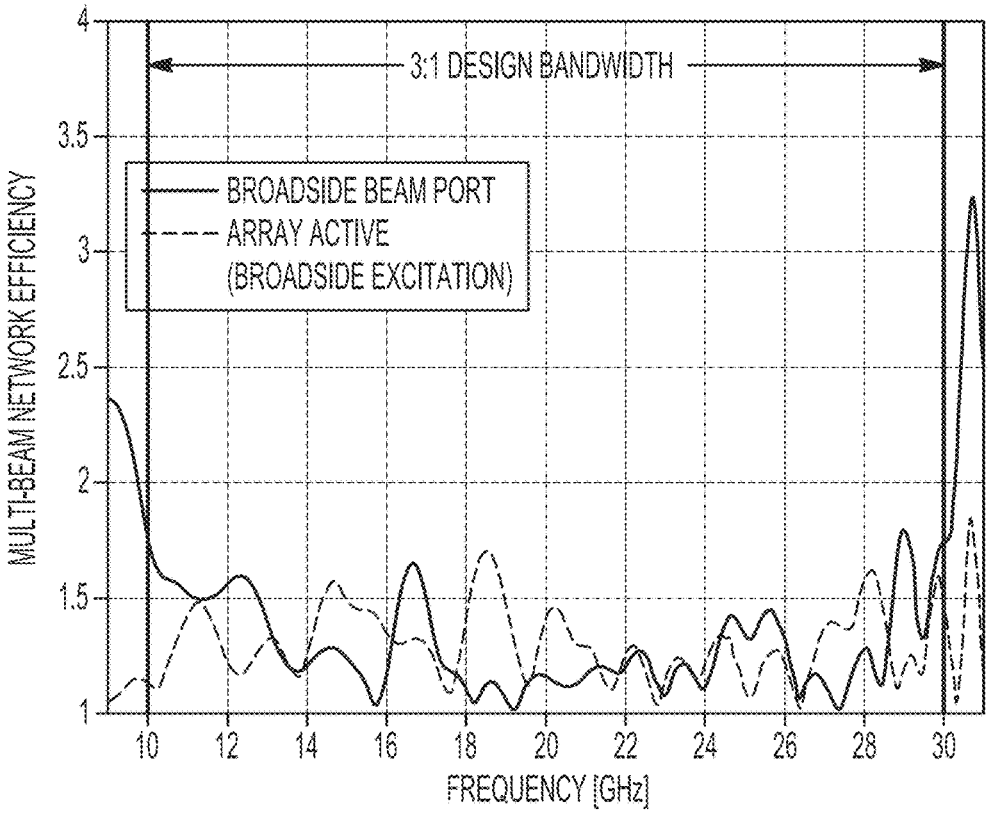
FIG. 14 plots the VSWR versus frequency of the beam port and the active VSWR of the thirteen array ports under broadside excitation according to the present invention.

FIG. 14 plots the VSWR versus frequency of the beam port and the active VSWR of the thirteen array ports under broadside excitation. The present invention provides an excellent match to 50 Ω over the entire 10-30 GHz bandwidth.

III. RF Beamforming Architecture for UWB Continuous TTD Beam-Steering

The RF beamforming architecture described herein provides continuous wideband true-time delay without the use of tunable materials or loaded delay-lines. The RF beamforming architecture includes the compact ultrawideband parallel plate lens multi-beamformer core and passive electronics, such as power dividers, switches, and attenuators, for beam-steering control. These passive electronics are used to electronically control the lens-input signal phase center by controlling the amplitude excitations of appropriate beam port (e.g., monopole) subarrays in the lens. A simple amplitude control scheme of overlapping subarrays is described to continuously control the phase center location, and thus, the time-delay at the output of the beamformer. While the feeding scheme is described in relation to the compact ultrawideband parallel plate lens multi-beamformer core described herein, the feeding scheme may be used with any suitable TTD beamformer core.

Figure 15:
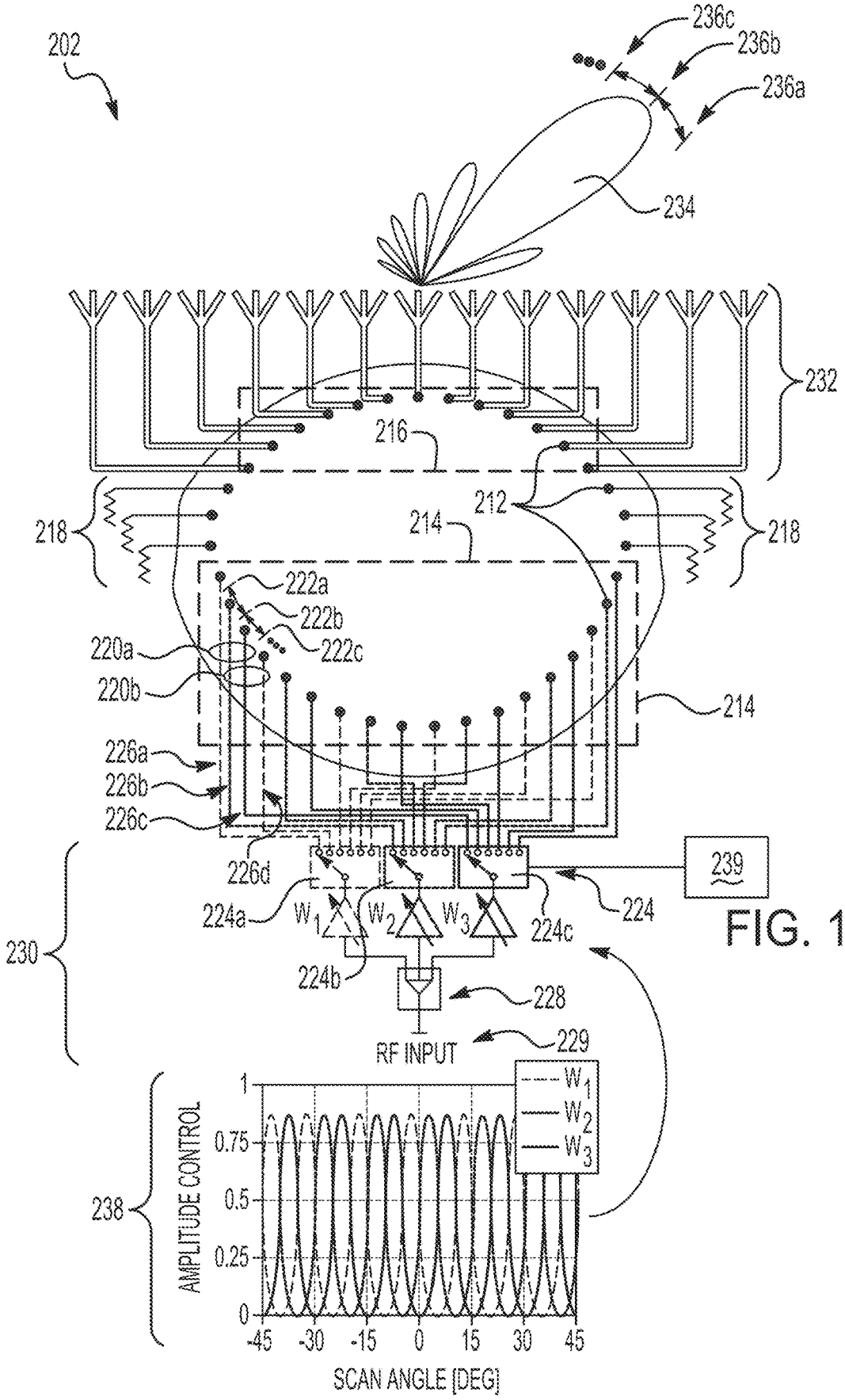
FIG. 15 shows a schematic view of a beamforming architecture according to the present invention.

FIG. 15 shows a schematic view of a beamforming architecture according to the present invention. The beamforming architecture 202 includes a multilayer beamformer core with a parallel plate lens 210 coupled to control electronics 230 and an antenna array 232.

The constrained lens 210 may be the parallel plate lens described herein with a densely packed wideband monopole probe array 212 to provide true time delay for energy input into the beamformer core. The monopole probe array 212 may have probes spaced at one-half the guided wavelength at the highest operating frequency of the system. Each monopole probe 212 is a capacitively loaded via in a multilayer package and may be a beam port in a beam-port arc 214, an array port in an array port arc 216, or a termination (e.g., dummy port) 218. The individual probes of the monopole array 212 may be divided into a plurality of subarrays 220 facilitating a signal to be transmitted anywhere along the beam-port arc 214. In an exemplary embodiment, a subarray 220 may be an n-probe array.

Each individual probe of a subarray 220*a* may be coupled to control electronics 230 for beam steering control. The control electronics 230 may include only passive electronics such as a plurality of switches 224, a plurality of amplitude controls, w, one or more power dividers 228, and an RF input 229. The plurality of amplitude controls may be variable attenuators. The power dividers 228 may be any suitable N-to-1 power divider such as Wilkinson dividers, Gysel dividers, active dividers, and the like. The switches 224 may be any suitable absorptive single-pole N-terminal switch such as the SP6T switches shown in FIG. 15. In some embodiments, the number of terminals is two times N of the N-to-1 power divider. The control electronics 230 are configured to use the switches 224 to move a phase center 222 along the beam port arc 214. To 'bridge' the gap between discrete beam locations, the beamforming architecture moves the phase center 222 from its geometrical center of a subarray 220 to nearby locations along the beam-port arc 214 by biasing the amplitude controls, w. The constrained lens 210 converts the phase center control to beam 234 direction control.

In an exemplary embodiment, an individual subarray 220*a* is selectively excited in the monopole array 212 using a first feed 226*a* from a first switch 224*a*, a second feed 226*b* from a second switch 224*b*, and a third feed 226*c* from a third switch 224*c*. Each switch is coupled to a respective amplitude control ($w_1$, $w_2$, $w_3$) to shift the phase center 222 anywhere along the constrained lens beam-port arc 214. The amplitude controls, w, may be variable gain amplifiers (VGAs), variable attenuators, and the like. A phase center location 222*a* corresponds to the individual subarray 220*a* excited by the control electronics 230. The control electronics 230 may be coupled to, and exchange data and commands with, an electronic controller 239 such as a processor, microprocessor, application specific integrated circuit, and the like.

The phase center 222*a* causes an antenna array 232 to emit a beam 234 at a corresponding position 236*a*. Shifting the phase center location 222 provides continuous TTD control on the array-port arc 216 of the lens 210. TTD control on the array-port arc 216 provides beam direction control proportional to the phase center location 222.

When the first amplitude control, $w_1$, coupled to the first feed 226*a* is turned off the phase center 222*b* moves and is now between the second probe coupled to the second feed 226*b* and the third probe coupled to the third feed 226*c*. Accordingly, shifting the input to a second phase center 222*b* causes the antenna array 232 to emit the beam 234 at a second corresponding position 236*b*. Next, the path for the first amplitude control, $w_1$, is switched from the first feed 226*a* coupled to the first probe of subarray 220*a* to the fourth probe, in subarray 220*b*, coupled to a second feed 226*d* from the first switch 224*a*. To shift to phase center 222*c*, the power is increased at the fourth probe, while power to the third amplitude controller, $w_3$, is lowered. Again, shifting the input to a third phase center location 222*c* causes the antenna array 232 to emit the beam 34 at a third corresponding position 236*c*. This cycle is continued, steering the beam across the designed range, i.e., +/−45° as shown in FIG. 15. Unexcited probes are coupled to absorptive switches. The beam is steered according to the true time delay caused by the constrained lens 210. The constrained lens 210 may be a quasi-optical RF device such as a Rotman lens, a Ruze lens, an R-kR lens, an R-2R lens, and the like.

Embodiments described herein employ amplitude control using control electronics 230 to produce multiple (one per array element) infinite-bit TTD units (limited only by the resolution of the amplitude control) coupled to a wideband power combiner/divider. The amplitude of a signal on each controller ($w_1$, $w_2$, and $w_3$) is shown in a bottom panel 238 for a corresponding scan angle. Each amplitude control curve corresponds to an amplitude controller ($w_1$, $w_2$, $w_3$). The beamformer core with a constrained lens 210, control electronics 230, and antenna array 232 provide a continuously variable TTD beam steering network.

Exciting overlapping subarrays 220 offers considerably higher beamforming efficiency due to less spillover losses in the termination ports 218 of the lens, while at the same time allows for much finer, but still discrete, angular beam resolution (which is proportional to the probe spacing).

Applications include determining a desired beam direction and adjusting the phase control center to output a signal at the desired beam directions. The system may be configured to detect changes in antenna position due to environmental factors such as vibration, vehicle movement, and the like and adjust the phase center accordingly.

The topology described in FIG. 15 is shown in transmit configuration and can also be used in receive configuration. One of ordinary skill in the art would recognize many variations, modifications, and alternatives.

Figure 16:
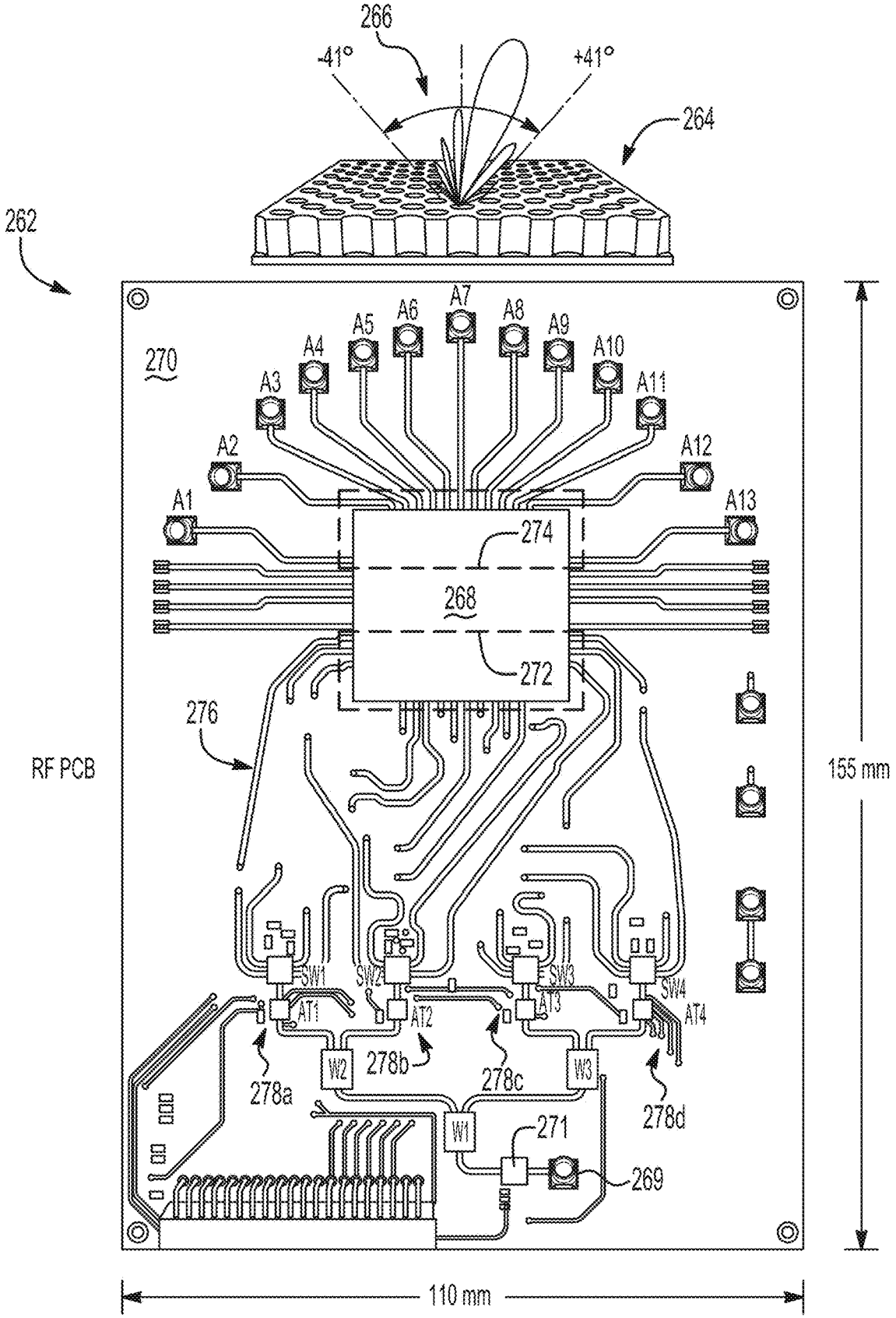
FIG. 16 shows an exemplary embodiment of the beamforming architecture according to the present invention.

FIG. 16 shows an exemplary embodiment of the beamforming architecture according to the present invention. The proposed beamforming architecture 262 is designed to feed a 13-element linear array 264 and is presented in transmit mode. The beamformer 262 operates approximately from 10 to 30 GHz and scans a range 266 of approximately to +/−40°. A custom low temperature co-fired ceramic (LTCC) beamformer core quad flat no-leads (QFN) package 268, as described herein is integrated on a two-layer RF PCB 270. The beamformer 268 is coupled to power dividers W1, W2, and W3, digital attenuators AT1, AT2, AT3, and AT4, and switches SW1, SW2, SW3, and SW4 integrated on the two-layer RF PCB prototype 270. The beamforming architecture 262 is well-matched across most of the 10-30 GHz band and has total insertion loss ranging from 3.7 dB to 8 dB that accounts for power dividing losses, while having good scan uniformity and beam pointing accuracy.

In the exemplary embodiment, the beamformer core 268 uses Rotman lens optics with 16 beam ports 272, 13 array ports 274, $\theta$=45°, $\alpha$=30°, $\beta$=0.9°, and focal length=1.94 mm on a ceramic substrate ($\epsilon_r$=7.7). Overall dimensions of the package are 31 mm L×35 mm W×1.6 mm H (3.1 $\lambda_{high}$×3.5 $\lambda_{high}$×0.16 $\lambda_{high}$), where $\lambda_{high}$ is the highest operating wavelength (in the exemplary embodiment, the free-space wavelength at 30 GHz).

The PCB 270 uses grounded coplanar waveguide (GCPW) transmission lines 76 on an 8 mil laminate layer such as Rogers® RO4003c. The proposed architecture includes four amplitude control channels 78, while only three channels are necessary for operation. This beam steering topology does require trace crossovers, accomplished by adding a second 8 mil laminate layer to allow for a second GCPW to be run on the backside of the board, separated by the ground plane. Crossovers are accomplished using plated through vias (PTVs) and careful design of the shape of the ground plane cutout between the two transmission line layers. The RF PCB 270 is shown feeding one 13 element row of a Planar Ultrawideband Modular Antenna (PUMA) array, shown with beamformer element spacing for 30 GHz (5 mm).

Figure 17:
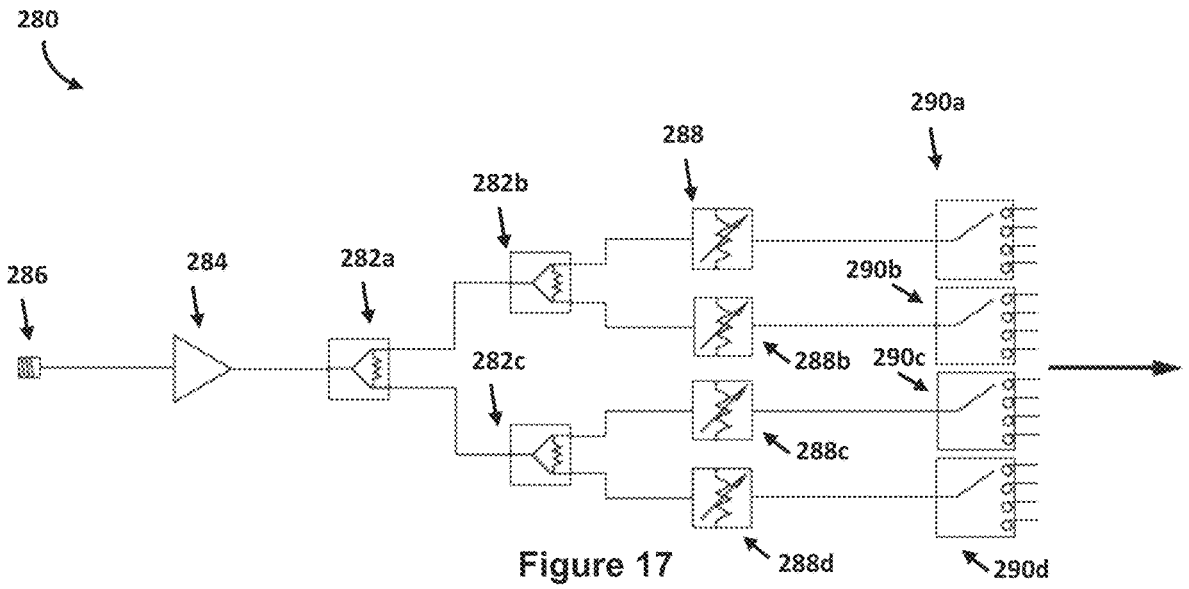
FIG. 17 shows a block diagram of a beamforming architecture control network according to the present invention.

FIG. 17 shows a block diagram of a beamforming architecture control network according to the present invention. The beamforming architecture control network 280 illustrates the four amplitude control channels 278 coupled to power dividers 282, a driver amplifier 284, and an RF input 286. Each control channel includes a digital attenuator 88 and a single-pole, four-throw (SP4T) switch 290. An exemplary embodiment of the beamforming architecture control network 280 is provided below.

A signal is input into the beamforming architecture control network 280 at the RF input 286 using, for example, an SMP coaxial connector. In the exemplary embodiment, the free-space wavelength may be 10-30 GHz. The signal is amplified by a driver amplifier 284. The driver amplifier 284 may be a suitable power amplifier with specifications such as a gain of 15 dB, a saturated power output of +18 dBm, an output IP3 of +25 dBm, and a 50-ohm matched input/output (e.g., Analog Devices® HMC 383LC4 GaAs PHEMT MMIC Driver Amplifier).

The amplified signal is transmitted to a first power divider/combiner 282*a*. The first power divider/combiner

282*a* is coupled to a second power divider/combiner 282*b* and a third power divider/combiner 282*c*. The power divider/combiner 282 may be a suitable divider/combiner with specifications in a 50-ohm system such as an operating frequency from 5 to 30 GHz, in-phase power splitting of 1.5 dB, insertion loss of 25 dB and output to output isolation. (e.g., Marki Microwave® PD-0530SMG Wilkinson Power divider).

The outputs of the second power divider/combiner 282*b* and the third power divider/combiner 282*c* are coupled to the amplitude control channels 278. The digital attenuator 288 of each amplitude control channel may be a suitable digital attenuator such as a wide band 6-bit digital attenuator covering up to 30 GHz. The attenuation bit-values may be 0.5 dB LSB (least significant bit), 1, 2, 4, 8, and 16 dB for a total attenuation of 31.5 dB. Typical insertion loss may be 8 dB at minimum attenuation. (e.g., MACOM MAAD-011021 Digital Attenuator).

Each digital attenuator 288 is coupled to a single-pole, four-throw (SP4T) switch 290. The switch may be a general-purpose SP4T switches with an ultra-wideband frequency range. The switches may be a non-reflective 50Ω design. The attenuators may provide high isolation, 50 ohms, and a low-insertion loss, 2 dB. (e.g., Analog Devices® ADRF5044 SP4T Switch).

Four-way power division into SP4T switches feeds the middle 16 beam ports 272 out of 18 on the beamformer core 268. This gives +/−40° scan of the available +/−45° range of this core. The digital attenuator 288 is configured to control the amplitude with low phase variation across attenuation states and frequency. In an alternative embodiment, variable gain amplifiers with gate control may be used in place of the digital attenuators 288 to improve device efficiency. The driver amplifier 284 may be used at the RF input 286 to overcome component and transmission line losses and may be removed depending on the application.

Performance of an embodiment of a multi-beamformer in accordance with the present invention is shown below using a full-wave high-frequency structure simulator. S-parameter values were combined with excitation amplitude weights in the simulations. Finite isolation and resolution of the digital attenuators can be seen in the figures. All full-wave simulations included dielectric and conductive losses as well as metal traces and grounds with finite thickness.

Figure 18:
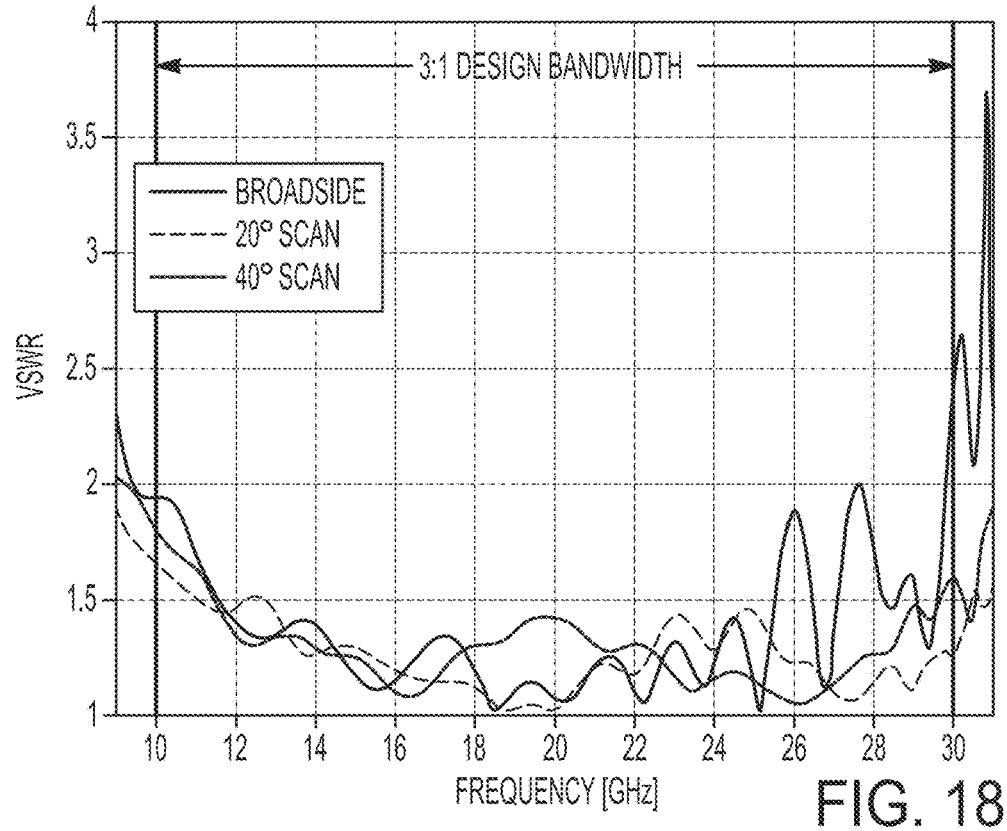
FIG. 18 shows a graph of the input active VSWR of the parallel plate lens beamformer core at various scan angles according to the present invention.

FIG. 18 shows a graph of the input active VSWR of the constrained lens beamformer core at various scan angles according to the present invention. Simulated active VSWR at the input ports of the beamformer core package for the broadside, +20°, and +40° beams are plotted in FIG. 18. The broadside and +40° beam directions both use two ports (probes) excited with equal power division. The +20° beam is a case where three ports are excited, centered over a single subarray. This covers the edge cases of probe excitation weights. The present invention provides a beamforming architecture with an active VSWR having a good match over the designed 10-30 GHz band and all scan angles and amplitude control weights. The impedance match deteriorates near broadside at 30 GHz due to increasing cavity reflections at the band edge. At the broadside, reflections are focused directly back at input, causing this degradation in VSWR. The results shown in FIG. 18 include the effects of the RF PCB to QFN package solder transitions.

Figure 19:
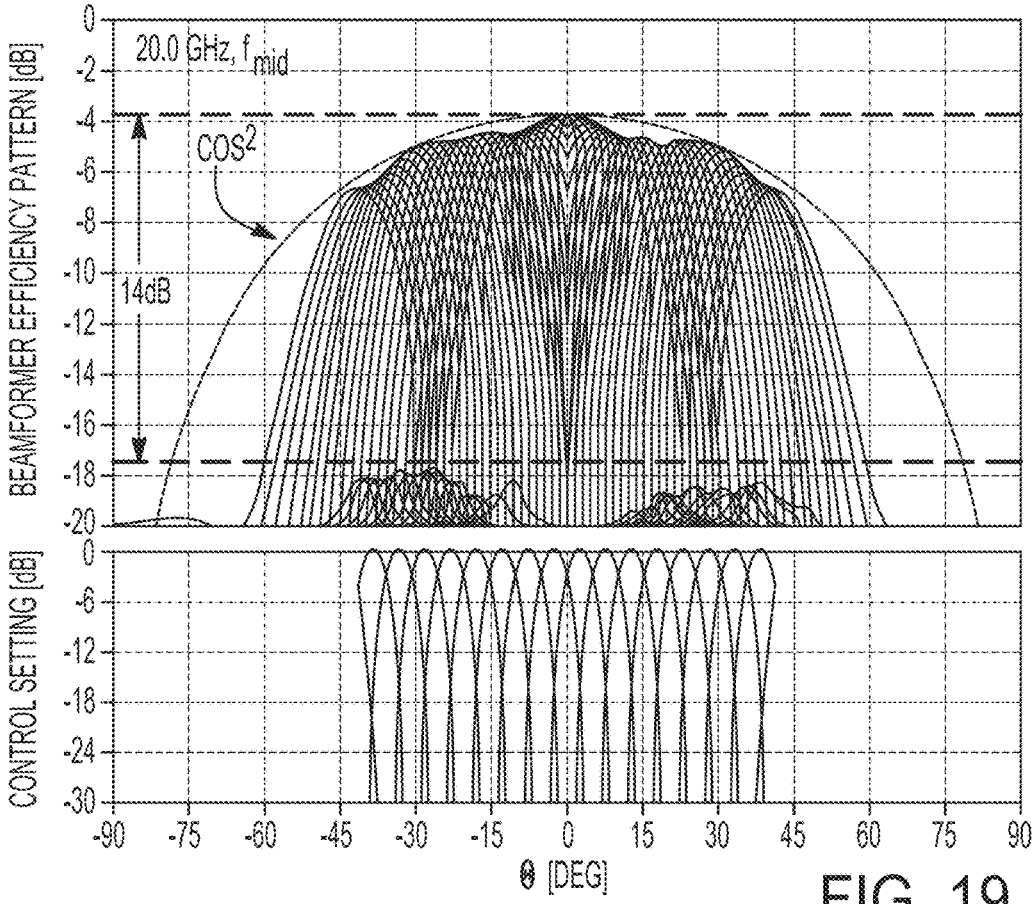
FIG. 19 shows a graph of beamforming network efficiency of the multi-beamformer at various control settings according to the present invention.

FIG. 19 shows a graph of beamforming network efficiency of the multi-beamformer at various control settings according to the present invention. The lower portion of FIG. 19 shows the amplitude control setting for a signal on each controller of the beamforming architecture. The amplitude control settings are used to shift the phase center of a signal anywhere along the constrained lens beam-port arc. The upper portion FIG. 19 plots the beam pattern scanned across the available range of −40° to +40° at the mid-band frequency of 20 GHz. This efficiency pattern used ideal isotropic radiators and is referenced to input power of 1 Watt. More specifically, RF beamforming losses from RF PCB and lens beamformer package, input mismatch, and the cos(θ) gain roll-off of a planar array, but does not include the aperture gain and it is also noted that component losses in the amplifier channels have been countered by the driver amplifier gain. Depending on application specific requirements, passive electronics, PCB traces, and crossovers could be incorporated on the beamformer core package to further mitigate component losses and improve performance.

The normalization shows how relative gain and side lobe level varies across the scan range with this beamforming method. The proposed design allows much finer scanning than shown (~0.1° step size), but it becomes difficult to distinguish between the different patterns. FIG. 19 also shows the control setting for the digital attenuator used to scan the beam. Full wave simulation of the beamformer core and RF PCB were used to create these plots. Comparison is made to a $\cos^2$ taper because the Rotman lens optics of the beamformer add an efficiency versus scan angle roll off that is approximately cosine, in addition to the cosine roll off of a planar array with scan. Quantization error due to using 6-bit digital attenuators is visible and has a small effect on beam pointing direction. Due to element switching, the 6 attenuation bits are reused across each 3-element sub-array. This results in an angular resolution that is less than 0.1°.

The beamforming architecture may include a calibration table to correct pointing errors to within +/−0.1°. FIG. 19 shows patterns with almost theoretical side-lobe levels and minor variations over the $\cos^2$ roll-off. Depending on application specific requirements, the PCB feed traces and required crossovers may be designed to reduce the asymmetry and ripple in the envelope of the peaks. For example, the crossovers and tightly curved traces begin to suffer radiation losses from around 26 GHz and adjusting gain values for the individual lines can be used to mitigate some or all this error. One of ordinary skill in the art would recognize many variations, modifications, and alternatives.

Figure 20A:
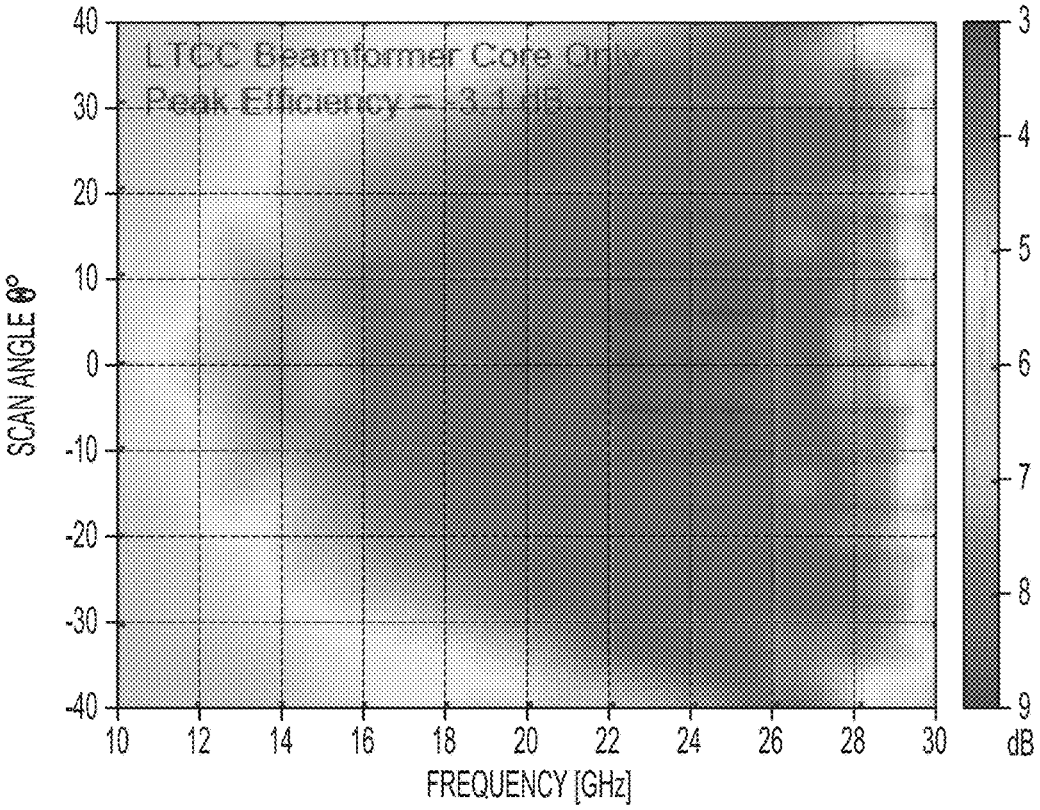
FIGS. 20A and 20B show a graph of beamforming efficiency versus frequency and scan angle according to the present invention.
Figure 20B:
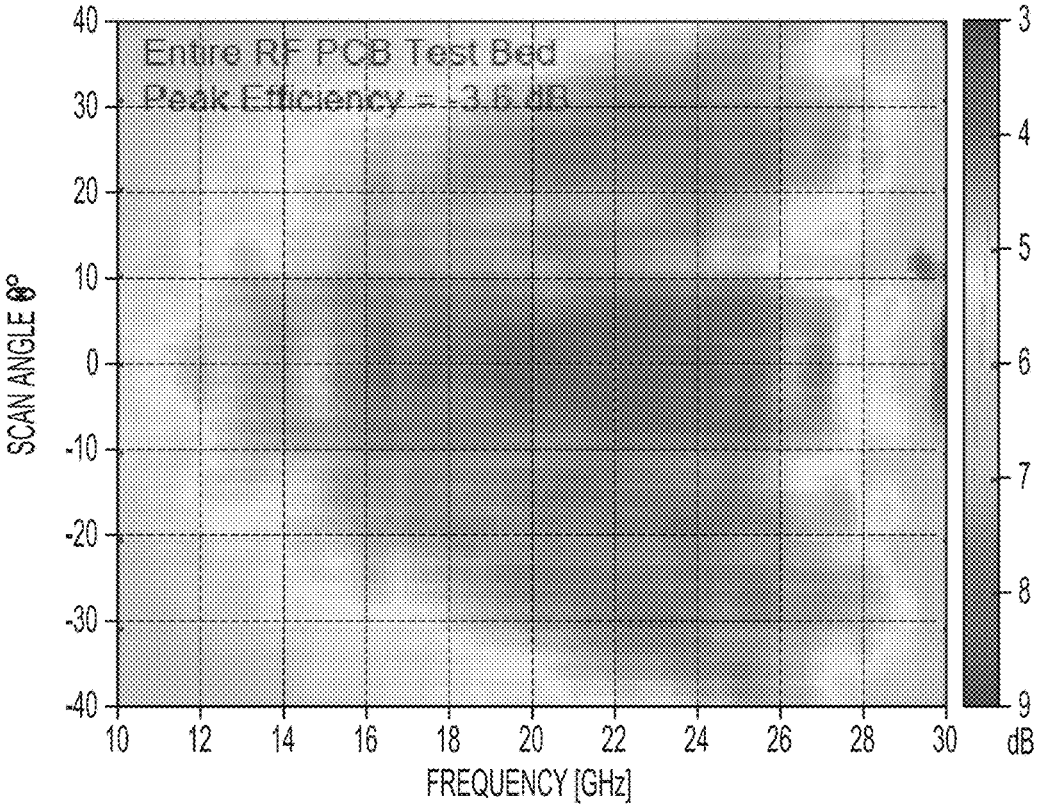

FIGS. 20A and 20B show a graph of beamforming efficiency versus frequency and scan angle according to the present invention. To show the performance over the frequency, the envelopes of the pattern peaks are plotted in FIG. 20A for the beamformer lens core 268 alone and in FIG. 20B for the entire RF PCB test bed 262. Efficiency increases with frequency from the low end (10 GHz) of the band, as beam port coupling and spillover losses in the constrained lens beamformer decrease. Over the middle portion of the band (12 GHz-26 GHz), efficiency hovers around 50% at broadside. Near the top end of the band (above 26 GHz) reflections within the lens increase, with the most significant effect being a decrease in input match for angles near broadside. The relationship between efficiency and frequency is visible in FIG. 7A, at 30 GHz efficiency is worst at broadside due to degrading match at the band edge.

FIG. 20B shows that the RF PCB causes some additional gain ripple versus pointing angle, as well as significant performance degradation above 27 GHz. The main contributor to this performance degradation is loss from the line crossovers. In an exemplary embodiment, these traces and crossings could be incorporated on the beamformer core package to significantly improve performance.

The RF beamforming architecture described herein may be used with a suitable core such as the parallel plate lens multi-beamformer described herein to convert amplitude weights into continuous TTD control. The RF beamforming architecture provides a simple and efficient control network for this topology. Full wave simulations show high beamforming efficiency over the frequency range of 10-27 GHz, and scan range of +/−40°. Additionally, the active components provide low amplitude and phase errors across the intended bands.

In some embodiments, implementations that leverage multilayer packaging, such as LTCC, may incorporate the entire feed network on the top surface of the constrained lens beamformer core using die versions of the control electronics.

Figure 21:
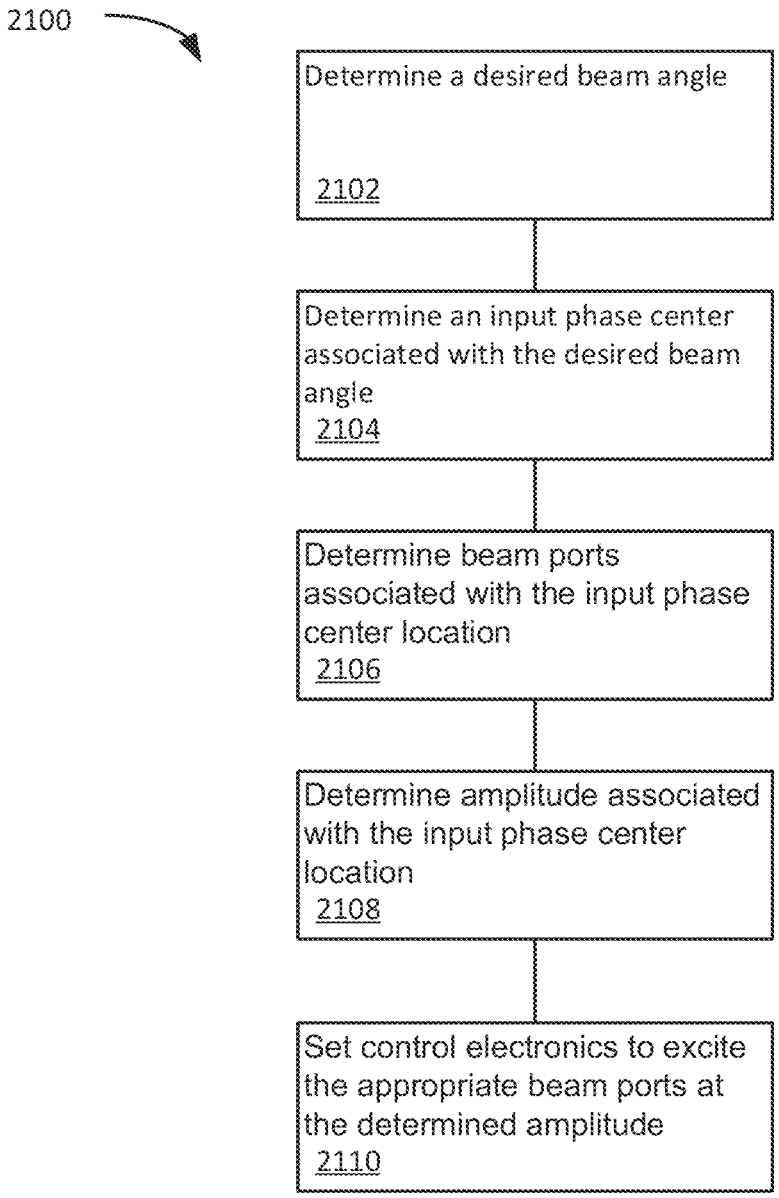
FIG. 21 shows a method of electronically controlling beamforming architecture.

FIG. 21 shows a method of electronically controlling beamforming architecture. The method 2100 provides a plurality of steps to control a lens input phase center location to facilitate beam steering. At step 2102, a desired beam angle is determined. An electronic controller such as a microcontroller, processor, or the like may receive information related to the desired beam angle. The electronic controller may determine the desired beam angle based on data calculated or received from another source. The electronic controller may include, or be coupled to, various environmental sensors that detect data associated with environmental properties that may affect beam angle such as accelerometers, geolocation sensors, and the like. The data may be used by the electronic controller to determine the beam angle.

At step 2104, determine an input phase center location associated with the desired beam angle. The electronic controller may include a memory that stores data associated with the transmission properties of a beamformer core. Based on those properties, the input phase center may be determined. Various properties that may affect the input phase center location include frequency, probe spacing, probe position, signal amplitude, number of signals, port spacing, antenna properties, and the like.

At step 2106, determine beam ports associated with the input phase center location. The beam ports may be determined based on one or more of the beamformer core dimensions, signal amplitude, frequency, and the like.

At step 2108, determine amplitude associated with the input phase center location. The amplitude may be adjusted on multiple beam ports to 'bridge' the gap between discrete beam locations.

At step 2110, set control electronics to excite the appropriate beam ports at the determined amplitude. Upon exciting the appropriate beam ports, the beamforming architecture outputs a beam at the appropriate beam angle. The control electronics may continue to monitor various inputs to detect changes in the desired beam angle.

While method 2100 is described in relation to transmission, reception at a specific phase center may also be implemented using the various embodiments of a beamformer core described herein.

It should be appreciated that the specific steps illustrated in FIG. 21 provide a particular method of electronically controlling beamforming architecture according to an embodiment of the present invention. Other sequences of steps may also be performed according to alternative embodiments. Moreover, the individual steps illustrated in FIG. 21 may include multiple substeps that may be performed in various sequences as appropriate to the individual step. Furthermore, additional steps may be added or existing steps may be removed depending on the particular applications. One of ordinary skill in the art would recognize many variations, modifications, and alternatives.

Some embodiments of the present disclosure include a system including one or more processors. In some embodiments, the system includes a non-transitory computer readable storage medium containing instructions which when executed on the one or more processors, cause the one or more processors to perform part of all of one or more methods and/or part or all of one or more processes disclosed herein. Some embodiments of the present disclosure include a computer-program product tangibly embodied in a non-transitory machine-readable storage medium including instructions configured to cause one or more processors to perform part of all of one or more methods and/or part or all of one or more processes disclosed herein.

It is noted that the embodiments can be described as a process which is depicted as a flowchart, a flow diagram, a data flow diagram, a structure diagram, or a block diagram. Although a flowchart can describe the operations as a sequential process, many of the operations can be performed in parallel or concurrently. In addition, the order of the operations can be re-arranged. A process is terminated when its operations are completed, but can have additional steps not included in the figure. A process can correspond to a method, a function, a procedure, a subroutine, a subprogram, etc. When a process corresponds to a function, its termination corresponds to a return of the function to the calling function or the main function.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

The invention claimed is:

1. A parallel plate constrained lens for feeding an array antenna comprising:

a top plate;

a bottom plate;

a side-wall coupled to the top plate and the bottom plate to form the parallel plate constrained lens with a cavity;

a plurality of capacitive probe feeds disposed in the cavity at a spacing interval associated with a guided wavelength (λ) within the cavity;

one or more array ports; and at least one beam port;

wherein one or more capacitive probe feeds of the plurality of capacitive probe feeds is coupled to the one or more array ports; and wherein at least one capacitive probe feed of the plurality of capacitive probe feeds is coupled to the at least one beam port to cause a true time delay shift of energy input into the parallel plate constrained lens.

2. The parallel plate constrained lens of claim 1, wherein the spacing interval corresponds to $\lambda/2$ at the highest frequency of operation.

3. The parallel plate constrained lens of claim 1 further comprising a plurality of transmission lines connecting the at least one capacitive probe feed of the plurality of capacitive probe feeds to the at least one beam port and the one or more capacitive probe feeds to the one or more array ports, wherein each transmission line is characterized by a line length associated with a specific impedance.

4. The parallel plate constrained lens of claim 1, wherein two capacitive probe feeds of the plurality capacitive probe feeds are coupled to form a resistive divider.

5. The parallel plate constrained lens of claim 1, wherein each capacitive probe feed of the plurality of capacitive probe feeds is positioned at a distance from the side-wall corresponding to one-half the guided wavelength at the highest frequency of operation.

6. The parallel plate constrained lens of claim 1, wherein the plurality of capacitive probes is disposed at the spacing interval to define a concentric array with the side-wall.

7. The parallel plate constrained lens of claim 1, further comprising a dielectric material positioned in the cavity; wherein the plurality of capacitive probe feeds is disposed in the dielectric material.

8. The parallel plate constrained lens of claim 7, further comprising a backing cavity formed between the plurality of capacitive probe feeds and the side-wall.

9. The parallel plate constrained lens of claim 8, wherein the backing cavity is at least partially filled with a dielectric, the parallel plate constrained lens further comprising transmission lines provided on the dielectric within the backing cavity.

10. The parallel plate constrained lens of claim 7, wherein the backing cavity comprises at least one or more of air and a dielectric material.

11. The parallel plate constrained lens of claim 1 further comprising a metal cap coupled to each capacitive probe feed of the plurality of capacitive probe feeds.

12. The parallel plate constrained lens of claim 1, wherein at least a portion of the plurality of capacitive probe feeds is coupled to a termination.

13. The parallel plate constrained lens of claim 1, further comprising a plurality of transmission lines connecting each capacitive probe feed of the plurality of capacitive probe feeds to a corresponding lead disposed on the bottom plate.

14. The parallel plate constrained lens of claim 1, wherein the side-wall comprises a plurality of vias coupled to the top plate and the bottom plate to define the cavity, wherein a distance between vias of the plurality of vias is associated with the highest frequency of operation.

15. The parallel plate constrained lens of claim 1, further comprising a step-down ring disposed below the top plate and above the plurality of capacitive probe feeds, wherein the step-down ring is coupled to the top plate.

16. The parallel plate constrained lens of claim 1, wherein each capacitive probe feed of the plurality of capacitive probe feeds is identical.

17. The parallel plate constrained lens of claim 1, wherein the cavity is a sealed cavity, the parallel plate constrained lens further comprising transmission lines provided within the sealed cavity.

18. The parallel plate constrained lens of claim 1, wherein each capacitive probe feed of the plurality of capacitive probe feeds is a monopole-based probe feed.

19. The parallel plate constrained lens of claim 1, wherein the top plate, the bottom plate, and the side-wall are ground planes surrounding at least three sides of each capacitive probe feed of the plurality of capacitive probes.

* * * * *